US007465031B2

(12) United States Patent
Eguchi et al.

(10) Patent No.: US 7,465,031 B2
(45) Date of Patent: Dec. 16, 2008

(54) LIQUID-EJECTION APPARATUS

(75) Inventors: Takeo Eguchi, Kanagawa (JP); Manabu Tomita, Kangawa (JP); Iwao Ushinohama, Kanagawa (JP); Shogo Ono, Kanagawa (JP)

(73) Assignee: Sony Corporation, Tokyo (JP)

( * ) Notice: Subject to any disclaimer, the term of this patent is extended or adjusted under 35 U.S.C. 154(b) by 115 days.

(21) Appl. No.: 10/960,815

(22) Filed: Oct. 7, 2004

(65) Prior Publication Data

US 2005/0116996 A1 Jun. 2, 2005

(30) Foreign Application Priority Data

Oct. 10, 2003 (JP) ..... 2003-351550
Dec. 5, 2003 (JP) ..... 2003-407584

(51) Int. Cl.
*B41J 2/05* (2006.01)

(52) U.S. Cl. ..... 347/57; 347/9; 347/11

(58) Field of Classification Search ..... 347/5, 347/9, 10, 14, 19, 20, 48, 56–59, 61–62, 347/67, 65
See application file for complete search history.

(56) References Cited

U.S. PATENT DOCUMENTS 4,251,824 A * 2/1981 Hara et al. ..... 347/57
5,481,287 A 1/1996 Tachihara ..... 347/62
6,318,847 B1 11/2001 Wade ..... 347/62
6,749,286 B2 6/2004 Eguchi ..... 397/48
6,817,704 B2 * 11/2004 Eguchi et al. ..... 347/60

FOREIGN PATENT DOCUMENTS

| | | |
|---|---|---|
| EP | 1354704 | 10/2003 |
| EP | 1428665 | 6/2004 |
| JP | 04-173249 | 6/1992 |
| JP | 05-208496 | 8/1993 |
| JP | 06-198884 | 7/1994 |
| JP | 06-320735 | 11/1994 |
| JP | 08-048034 | 2/1996 |
| JP | 09-131877 | 5/1997 |
| JP | 2000-185403 | 7/2000 |
| JP | 2001-105584 | 4/2001 |
| JP | 2005-219563 | 8/2001 |
| JP | 2002-240287 | 8/2002 |
| JP | 2002-273883 | 9/2002 |
| JP | 2003-072078 | 3/2003 |
| JP | 2003-276202 | 9/2003 |

* cited by examiner

*Primary Examiner*—Juanita D Stephens
(74) *Attorney, Agent, or Firm*—Rockey, Depke & Lyons, LLC; Robert J. Depke

(57) ABSTRACT

Flying characteristics of ink droplets are controlled efficiently to the utmost. In one liquid chamber, two heating elements with the same surface-shape and the same heating characteristics are juxtaposed. While energy is simultaneously applied to the two heating elements, by applying energy with different energy surface-densities to the two heating elements so that the bubble-generating time with film boiling differs for the two heating elements, the liquid droplets are controlled so that a flying force with a component parallel to an ejection face of a nozzle is applied to the liquid droplets in a growing process of the liquid droplets.

15 Claims, 35 Drawing Sheets

FIG. 7A
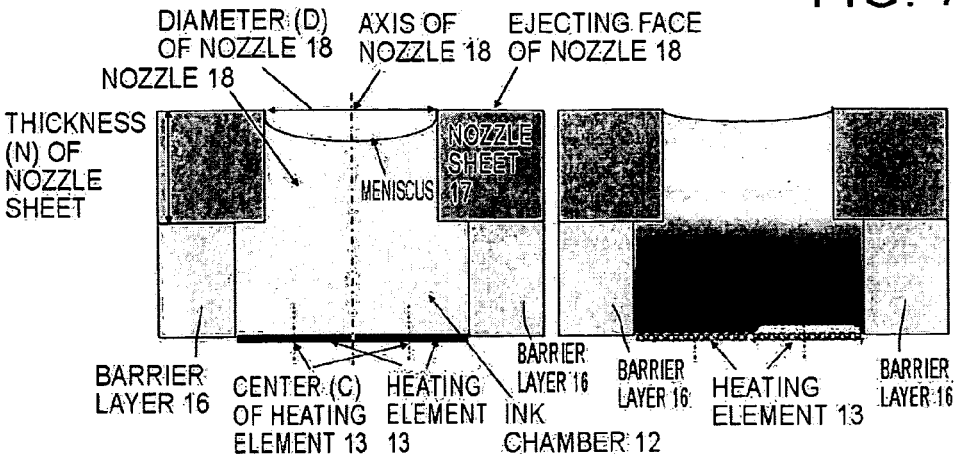
FIG. 7B
FIG. 7C
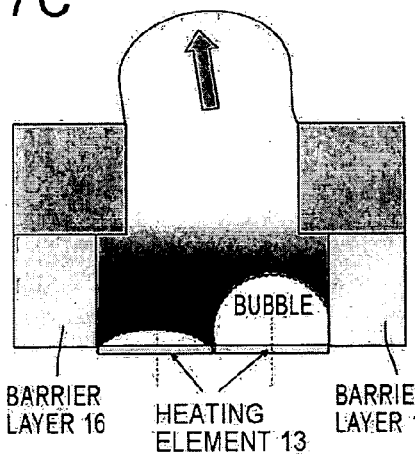
FIG. 7D
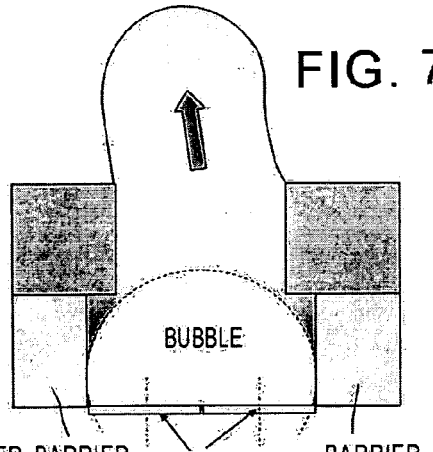
FIG. 7E
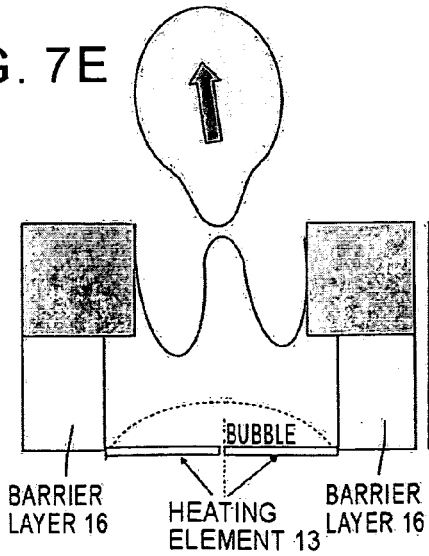
FIG. 7F
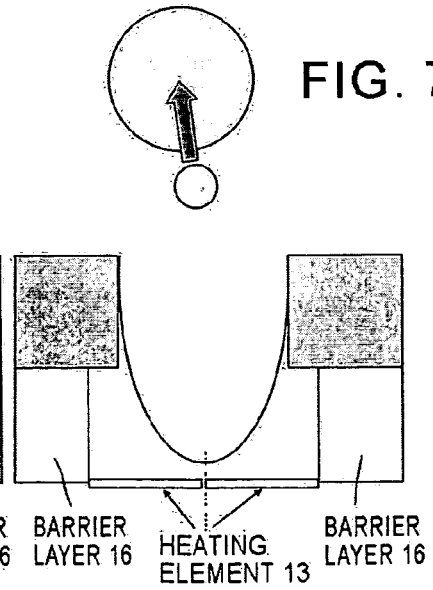

FIG. 28

| EX-PERI-MENT | OPENING SHAPE OF NOZZLE 18 | | | THICKNESS OF BARRIER LAYER 16 | THICKNESS OF NOZZLE SHEET 17 | HEIGHT OF INK CHAMBER 12 | DEFLECTION | EVALUATION 1 | EVALUATION 2 | EVALUATION 3 | EVALUATION 4 | EVALUATION 5 |
|---|---|---|---|---|---|---|---|---|---|---|---|---|
| | TYPE | (Dx) | (Dy) | (K) | (N) | H=K+N | (Y) | 10Y/K | 10Y/N | 100Y/(KN) | 10D/H | 5D/N |
| 1 | CIRCLE | 10.9 | ⇐ | 9.2 | 12.0 | 21.2 | 0.3 | 0.3 | 0.2 | 0.2 | 5.1 | 4.5 |
| 2 | | 11.3 | ⇐ | 9.2 | 8.7 | 17.9 | 22.2 | 24.1 | 25.5 | 27.7 | 6.3 | 6.5 |
| 3 | | 15.2 | ⇐ | 9.2 | 12.0 | 21.2 | 25.7 | 27.9 | 21.4 | 23.3 | 7.2 | 6.3 |
| 4 | | 19.8 | ⇐ | 9.2 | 12.0 | 21.2 | 48.0 | 52.2 | 40.0 | 43.5 | 9.3 | 8.3 |
| 5 | | 20.5 | ⇐ | 9.2 | 8.7 | 17.9 | 77.6 | 84.3 | 89.2 | 97.0 | 11.5 | 11.8 |
| 6 | | 10.4 | ⇐ | 9.9 | 14.7 | 24.6 | −6.0 | −6.1 | −4.1 | −4.1 | 4.2 | 3.5 |
| 7 | | 19.8 | ⇐ | 9.9 | 14.7 | 24.6 | 29.8 | 30.1 | 20.3 | 20.5 | 8.1 | 6.7 |
| 8 | | 11.0 | ⇐ | 10.5 | 13.5 | 24.0 | −9.0 | −8.6 | −6.7 | −6.3 | 4.6 | 4.1 |
| 9 | | 20.0 | ⇐ | 10.5 | 13.5 | 24.0 | 32.0 | 30.5 | 23.7 | 22.6 | 8.3 | 7.4 |
| 10 | | 12.3 | ⇐ | 12.9 | 7.5 | 20.4 | 18.0 | 14.0 | 24.0 | 18.6 | 6.0 | 8.2 |
| 11 | | 17.0 | ⇐ | 12.9 | 7.5 | 20.4 | 57.0 | 44.2 | 76.0 | 58.9 | 8.3 | 11.3 |
| 12 | | 21.1 | ⇐ | 12.9 | 7.5 | 20.4 | 88.0 | 68.2 | 117.3 | 91.0 | 10.3 | 14.0 |

MEASURED VALUES

PROVISIONAL CALCULATIONS FOR CORRELATION

FIG. 29

| EX-PERI-MENT | OPENING SHAPE OF NOZZLE 18 | | | THICKNESS OF BARRIER LAYER 16 | THICKNESS OF NOZZLE SHEET 17 | HEIGHT OF INK CHAMBER 12 | DEFLECTION | EVALUATION 1 | EVALUATION 2 | EVALUATION 3 | EVALUATION 4 | EVALUATION 5 |
|---|---|---|---|---|---|---|---|---|---|---|---|---|
| | TYPE | (Dx) | (Dy) | (K) | (N) | H=K+N | (Y) | 10Y/K | 10Y/N | 100Y/(KN) | 10D/H | 5D/N |
| 1 | CIRCLE | 12.2 | ⇐ | 10.4 | 11.9 | 22.3 | -3.0 | -2.9 | -2.5 | -2.4 | 5.5 | 5.1 |
| 2 | | 17.1 | ⇐ | | | | 24.8 | 23.8 | 20.8 | 20.0 | 7.7 | 7.2 |
| 3 | | 20.2 | ⇐ | | | | 47.8 | 46.0 | 40.2 | 38.6 | 9.1 | 8.5 |
| 4 | | 25.2 | ⇐ | | | | 72.0 | 69.2 | 60.5 | 58.2 | 11.3 | 10.6 |
| 5 | ELLIPSE | 16.2 | 13.8 | | | | 20.3 | 19.5 | 17.1 | 16.4 | 7.3 | 6.8 |
| 6 | | 20.1 | 12.6 | | | | 43.5 | 41.8 | 36.6 | 35.1 | 9.0 | 8.4 |
| 7 | | 23.2 | 14.0 | | | | 61.0 | 58.7 | 51.3 | 49.3 | 10.4 | 9.7 |
| 8 | | 21.1 | 17.3 | | | | 56.5 | 54.3 | 47.5 | 45.7 | 9.5 | 8.9 |
| 9 | | 25.9 | 17.0 | | | | 82.2 | 79.0 | 69.1 | 66.4 | 11.6 | 10.9 |
| 10 | | 30.3 | 17.0 | | | | 102.5 | 98.6 | 86.1 | 82.8 | 13.6 | 12.7 |
| 11 | | 25.0 | 20.0 | | | | 67.3 | 64.7 | 56.6 | 54.4 | 11.2 | 10.5 |
| 12 | | 26.0 | 21.7 | | | | 77.5 | 74.5 | 65.1 | 62.6 | 11.7 | 10.9 |
| 13 | | 28.3 | 20.0 | | | | 81.8 | 78.7 | 68.7 | 66.1 | 12.7 | 11.9 |

MEASURED VALUES

PROVISIONAL CALCULATIONS FOR CORRELATION

FIG. 32

| EXPERIMENT | OPENING SHAPE OF NOZZLE 18 | | | | DOT DIAMETER |
|---|---|---|---|---|---|
| | TYPE | Dx | Dy | AREA (S) | Φ |
| 1 | CIRCLE | 12.2 | ← | 116.9 | 27 |
| 2 | | 17.1 | ← | 229.7 | 38 |
| 3 | | 20.2 | ← | 320.5 | 42 |
| 4 | | 25.2 | ← | 498.8 | 46 |
| 5 | ELLIPSE | 16.2 | 13.8 | 182.7 | 34 |
| 6 | | 20.1 | 12.6 | 219.2 | 39 |
| 7 | | 23.2 | 14.0 | 282.7 | 40 |
| 8 | | 21.1 | 17.3 | 300.8 | 42 |
| 9 | | 25.9 | 17.0 | 378.3 | 46 |
| 10 | | 30.3 | 17.0 | 453.1 | 46 |
| 11 | | 25.0 | 20.0 | 414.2 | 43 |
| 12 | | 26.0 | 21.7 | 463.1 | 44 |
| 13 | | 28.3 | 20.0 | 480.2 | 46 |

LIQUID-EJECTION APPARATUS

The present application claims priority to Japanese Patent Application JP2003-351550, filed in the Japanese Patent Office Oct. 10, 2003, and Japanese Patent Application JP2003-407584, filed in the Japanese Patent Office Dec. 5, 2003; the entire contents of which are incorporated herein by reference.

BACKGROUND OF THE INVENTION

1. Field of the Invention

The present invention relates to a technique for controlling flight characteristics or landing positions of liquid in a liquid-ejecting apparatus for ejecting the liquid contained in a liquid chamber from nozzles, and more specifically it relates to a technique for controlling a liquid-ejecting direction (liquid-landing position) from a liquid-ejection unit in a liquid-ejecting apparatus having a head where a plurality of the liquid-ejection units are juxtaposed to each other.

2. Description of the Related Art

An ink-jet printer has been known as an example of the liquid-ejecting apparatus having the head where a plurality of the liquid-ejection units are juxtaposed to each other. Also, a thermal system has been known as a system of the ink-jet printer for ejecting ink droplets using thermal energy.

As an example of the thermal-system printer-head chip structure, there is a structure in that ink in an ink chamber is heated by a heating element (heating resistor) so as to generate bubbles in the ink on the heating element, so that part of the ink is ejected as ink droplets by the energy produced during the bubbling. A nozzle is arranged above the ink chamber so that the ink droplets are ejected from a nozzle outlet when bubbles are generated in the ink contained in the ink chamber.

Furthermore, in view of the head structure, a serial system has been widely known in that the printer-head chips are moved in the width direction of photographic paper. Also, as is disclosed in Japanese Unexamined Patent Application Publication No. 2002-36522, a line system in that a large number of printer-head chips are arranged in the width direction of photographic paper so as to form a line head for the width of photographic paper is known.

FIG. 34 is a plan view of a conventional line head 10. In FIG. 34, four printer-head chips 1 ([N−1], [N], [N+1], and [N+2]) are shown; however, a further large number of the printer-head chips 1 are juxtaposed in practice.

Each printer head chip 1 is provided with a plurality of nozzles 1*a* having ejection openings for ejecting ink droplets. The nozzles 1*a* are juxtaposed in a specific direction, which agrees with the width direction of photographic paper. Furthermore, a plurality of the printer-head chips 1 are juxtaposed in a in a specific direction. In the printer-head chips 1 adjacent to each other, while the respective nozzles 1*a* are arranged so as to oppose each other, between the adjacent printer-head chips 1, the nozzles 1*a* are arranged so that the pitch thereof is sequential (see detailed portion A).

However, in the above-mentioned technique of Japanese Unexamined Patent Application Publication No. 2002-36522, when ink droplets are ejected from the printer-head chips 1, the ink droplets are ideally ejected normally to the ejection face of the printer-head chips 1; however, by various factors, the ejecting angle of the ink droplets may not be normal in practice.

For example, when a nozzle sheet having the nozzles 1*a* formed thereon is bonded on the upper surface of the ink chamber having the heating element, there arises a problem of a positional displacement between the ink chamber, the heating element, and the bonded position of the nozzle 1*a*. If the nozzle sheet is bonded so that the nozzle 1*a* is centered on the axes of the ink chamber and the heating element, ink droplets are ejected perpendicularly to the ejection face (the nozzle sheet surface). Whereas, if the nozzle 1*a* is not centered on the axes of the ink chamber and the heating element, ink droplets are not ejected perpendicularly to the ejection face.

Also, the positional displacement due to the difference in thermal expansion coefficient between the ink chamber, the heating element, and the nozzle sheet may be produced.

When ink droplets are ejected perpendicularly to the ejection face, it is assumed that the ink droplets be ideally landed at precise positions. If the ejecting angle of ink droplets is deflected by θ from the normal, when the distance H between the ejection face and photographic paper (landing surface of ink droplets) is constant (generally 1 to 2 mm in an ink-jet system), the positional displacement ΔL of the landing position of ink droplets is:

$$\Delta L = H \times \tan\theta.$$

When such a displacement in an ejecting angle of ink droplets is produced herein, in the serial system, the landing pitch slippage of ink droplets appears between the nozzles 1*a*. In the line system, in addition to the landing pitch slippage, the deflection of the landing position appears between the printer-head chips 1.

FIG. 35 includes a sectional view and a plan view showing image-printing state in the line head 10 (a plurality of the printer-head chips 1 arranged in the arranging direction of the nozzles 1*a*) shown in FIG. 34. In FIG. 35, if the photographic paper P is assumed fixed, the line head 10 does not move in the width direction of the photographic paper P but it moves vertically in plan view so as to print images.

The sectional view of FIG. 35 shows the three printer-head chips 1 of Nth, (N+1)th, and (N+2)th printer-head chip 1, among the line head 10.

In the Nth printer-head chip 1, as shown by arrow of the sectional view, ink droplets are ejected slantingly in the left; also in the (N+1)th printer-head chip 1, in the right; and in the(N+2)th printer-head chip 1, as shown be arrow, ink droplets are ejected vertically without deflection.

Thus, in the Nth printer-head chip 1, ink droplets are landed at a deflected position in the left from a reference position; in the (N+1)th printer-head chip 1, in the right therefrom, so that ink droplets are landed at both positions receding from each other. As a result, between the Nth printer-head chip 1 and the (N+1)th printer-head chip 1, a region, on which no ink droplets are ejected, is formed. The line head 10 does not move in the width direction of the photographic paper P but moves only in arrow direction in plan view. Hence, between the Nth printer-head chip 1 and the (N+1)th printer-head chip 1, a white stripe B is produced, so that a problem has arisen that printed image quality is deteriorated.

In the same way as in the above-description, since in the (N+1)th printer-head chip 1, ink droplets are landed at a position deflected from the reference position in the right, between the (N+1)th printer-head chip 1 and the(N+2)th printer-head chip 1, a region where ink droplets are overlapped is formed. Thereby, there has been a problem that printed image quality is deteriorated by discontinuous images or a stripe C with a darker color than original one.

When the landing positional displacement of ink droplets is produced as described above, whether the stripe is conspicuous is affected by printed images. For example, a document has many blank portions, so that even if the stripe were produced, it is not so conspicuous. Whereas, when picture images are printed with full color on the almost entire region of photographic paper, even when a slight stripe is produced, it becomes conspicuous.

In order to prevent the stripe described in FIG. 35 from being produced, Japanese Unexamined Patent Application Publication No. 2002-240287, to the same assignee, proposes a technique.

In Japanese Unexamined Patent Application Publication No. 2002-240287, a plurality of the heating elements (heaters), which can be independently driven, are provided within the ink chamber, so that the ejection direction of ink droplets can be changed by independently driving each heating element. It has been considered that the generation of the stripe (white stripe B or stripe C) is solved by the technique of Japanese Unexamined Patent Application Publication No. 2002-240287.

In Japanese Unexamined Patent Application Publication No. 2002-240287, the ejection direction of ink droplets is deflected by independently controlling a plurality of heating elements; however, with the examination thereafter, when this technique is adopted, ink droplets may be ejected unstably, so that a problem has been proved in that high-quality images cannot be stably obtained.

According to the investigation by the inventors, in general, the election amount of ink droplets from the liquid ejection part does not simply increase with increasing electric power applied to the heating element, so that the ejection is not performed until a predetermined amount of electric power is applied thereto. In other words, if a predetermined amount of electric power or more is not applied, a sufficient amount of ink droplets cannot be ejected.

Hence, when a plurality of heating elements are independently driven, if ink droplets are ejected by driving only some parts of the heating element, a sufficient calorific value required for ejecting ink droplets must be generated only by this parts of the heating element. Thus, when a plurality of heating elements are independently driven, and ink droplets are ejected by driving only some parts of the heating element, it is necessary that electric power applied to the parts of the heating element be increased. Such situation is unfavorable for the miniaturization of the heating element with the recent progress to higher resolution.

That is, in order to stably eject ink droplets, a yield of energy per unit area of each heating element must be increased than before. As a result, the miniaturized heating element may be damaged more badly, thereby reducing the life of the heating element as well as of the head.

In conclusion, in the head having the heating element miniaturized with the progress to higher resolution, the stripe cannot be prevented from being generated with the above-described various techniques.

SUMMARY OF THE INVENTION

The problems described above have been solved by the following solving means of the present invention.

A liquid-ejection apparatus according to the present invention includes a liquid chamber for accommodating liquid to be ejected, a heating element arranged within the liquid chamber, and a nozzle-forming member having nozzles formed thereon for ejecting liquid droplets from the liquid chamber, wherein energy is applied to the heating element for heating it so as to apply a flying force to the liquid in the liquid chamber by generating bubbles with film boiling on the heating element, and part of the liquid in the liquid chamber is separated as liquid droplets by pressure changes due to the contraction of the bubble after generation so as to eject the liquid droplets from the nozzle, wherein the heating element arranged in one liquid chamber is composed of two juxtaposed bubble-generating regions with the same surface-shape and the same heating characteristics, and wherein by applying energy with different energy surface-densities to the two respective bubble-generating regions simultaneously so that the bubble-generating time with film boiling differs for the two bubble-generating regions, the liquid droplets are controlled so that a flying force with a component parallel to an ejection face of the nozzle is applied to the liquid droplets in a growing process of the liquid droplets.

According to the present invention, in one liquid chamber, two bubble-generating regions with the same surface-shape and the same heating characteristics are juxtaposed. When ink droplets are ejected, by applying energy with different energy surface-densities to the two respective bubble-generating regions simultaneously (at the same time) so that the bubble-generating time with film boiling differs for the two bubble-generating regions.

In addition, "two bubble-generating regions" according to the present invention are described in an embodiment below using two heating elements 13; however, the heating element 13 is not physically divided (separated), but is connected, so that each heating element 13 has the bubble-generating regions. Accordingly, "two bubble-generating regions" mean the same as the two heating elements 13 according to the embodiment.

According to the present invention, energy is simultaneously applied to two bubble-generating regions with the same surface-shape and the same heating characteristics while energy surface-density of the applied energy is changed, so that a flying force necessary for ejection is applied to liquid droplets while the flying force of the liquid droplets has a component parallel to an ejection face of the nozzle. In accordance with the difference between applied energy surface-densities, the ejecting direction of liquid droplets (to what degree liquid droplets are deflected or in what direction liquid droplets are ejected, for example) can be easily controlled.

BRIEF DESCRIPTION OF THE DRAWINGS

FIGS. 7A to 7F are sectional views of one liquid ejection part sequentially showing the states of the heating element from before being heated to ink droplets are ejected after being heated;

FIG. 28 is a table showing twelve experimental results versus evaluation items;

FIG. 29 is a table showing experimental results versus evaluation items regarding the nozzle with opening shapes of a circle and an oblong;

FIG. 32 is a table showing a plurality of kinds of the opening diameters and opening areas of the nozzle versus dot diameters obtained from experimental results of Example 3;

DESCRIPTION OF THE PREFERRED EMBODIMENTS

The inventors have been already proposed Japanese Patent Application No. 2002-320861 and No. 2003-55236, which are unpublished earlier applied techniques. By means of these techniques, flight characteristics or landing positions of ink droplets can be controlled while liquid is stably ejected without reducing the service life of heating elements.

Thereafter the inventors have been further studied how to reduce variations in flight characteristics of ink droplets for practical application. On the basis of the above techniques of Japanese Patent Application No. 2002-320861 and No. 2003-55236, we have elucidated the optimum relationship in size between a nozzle and a liquid chamber for efficiently controlling flight characteristics of ink droplets to the utmost.

Figure 1:
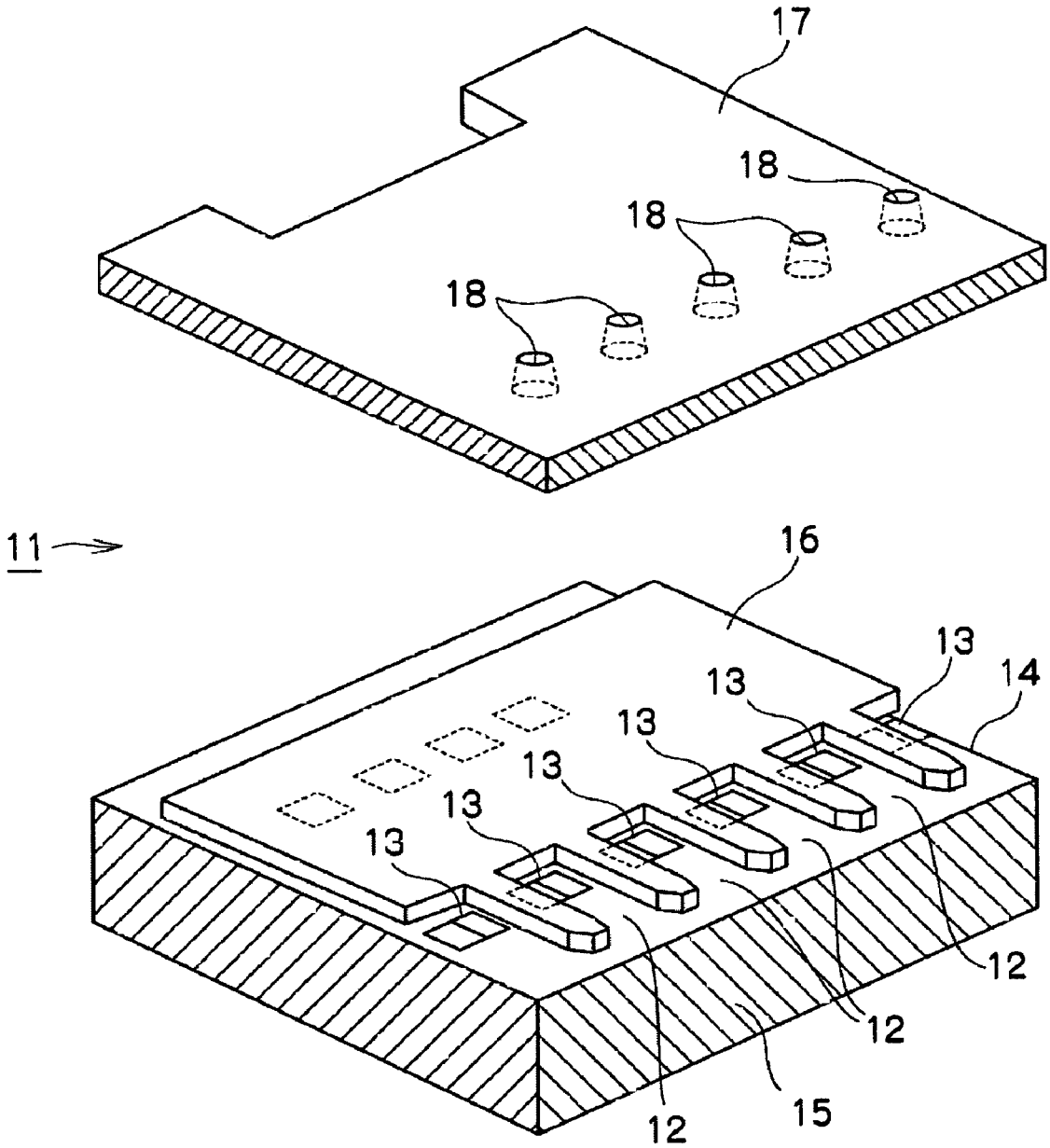
FIG. 1 is an exploded perspective view of a head of an ink-jet printer incorporating a liquid-ejection apparatus according to the present invention.

FIG. 1 is an exploded perspective view of a head 11 of an ink-jet printer (referred to as a printer simply below) incorporated in a liquid ejecting apparatus according to the present invention. Referring to FIG. 1, a nozzle sheet 17 (corresponding to a nozzle-forming member according to the present invention) is bonded on a barrier layer 16; in the drawing, the nozzle sheet 17 is exploded.

In the head 11, a substrate member 14 includes a semiconductor substrate 15 made of silicon, etc. and heating elements (heating resistors according to the embodiment) 13, which are deposited on one surface of the semiconductor substrate 15. The heating element 13 is electrically connected to a circuit, which will be described later, via a conduction part (not shown) formed on the semiconductor substrate 15.

A barrier layer 16, made of photosensitive cyclized rubber or an exposure curing dry-film resist, is formed by depositing it on the entire surface, having the heating elements 13 formed thereon, of the semiconductor substrate 15 so as to then remove unnecessary portions by a photolithographic process. Furthermore, the nozzle sheet 17 is provided with a plurality of nozzles 18 formed thereon. The nozzle 18 is produced by nickel electro-casting, for example, and the nozzle sheet 17 is bonded on the barrier layer 16 so that positions of the nozzles 18 agree with those of the heating elements 13, i.e., each nozzle 18 opposes each heating element 13.

An ink chamber 12 is constituted of the substrate member 14, the barrier layer 16, the nozzle sheet 17, and the nozzle 18 so as to surround the heating element 13. That is, in the drawing, the substrate member 14 forms the bottom wall of the ink chamber 12; internal walls of the barrier layer 16 and the nozzle 18 form side walls of the ink chamber 12; and the bottom surface of the nozzle sheet 17 forms the top of the ink chamber 12. Thereby, the ink chamber 12 has an opening on the front right of FIG. 1, so that the opening is communicated with an ink passage (not shown).

One head 11 mentioned above is generally provided with a plurality of the heating elements 13, on the order of 100 elements, and the ink chambers 12 having the respective heating elements 13. By a command from a printer control unit, a heating element 13 is uniquely selected from these heating elements 13 so that ink contained in the ink chamber 12 corresponding to this heating element 13 is ejected from the nozzle 18 opposing the ink chamber 12.

That is, the ink chamber 12 is filled with ink from an ink tank (not shown) connected to the head 11. Then, the heating element 13 is rapidly heated by a pulse current flowing for a short time, 1 to 3 μs, for example, and consequently, vapor-phase ink bubbles are generated in an ink portion contacting the heating element 13, so that a volume of ink is pushed away (ink is boiled) by the expansion of the ink bubbles. Thereby, almost the same volume of ink in a portion contacting the nozzle 18 as that of the pushed ink is ejected from the nozzle 18 as ink droplets so as to land on photographic paper (an object to be ejected by liquid).

In this specification, a part constituted of one ink chamber 12, the heating element 13 arranged within the one ink chamber 12, and part of the nozzle sheet 17 including the nozzle 18 arranged above the heating element 13 is defined by a "liquid (ink) ejection part". That is, the head 11 is composed of a plurality of the liquid ejection parts juxtaposed thereon.

According to the embodiment, in the same way as that of the conventional technique described above, a plurality of the heads 11 are arranged in the width direction of photographic paper so as to form a line head. In this case, a plurality of head chips (a chip is defined by the head 11 without the nozzle sheet 17) are arranged, and then one nozzle sheet 17 (having the nozzles 18 at positions corresponding to the entire ink chambers 12 of the respective head chips) is bonded on the head chips so as to form the line head.

Figure 2:
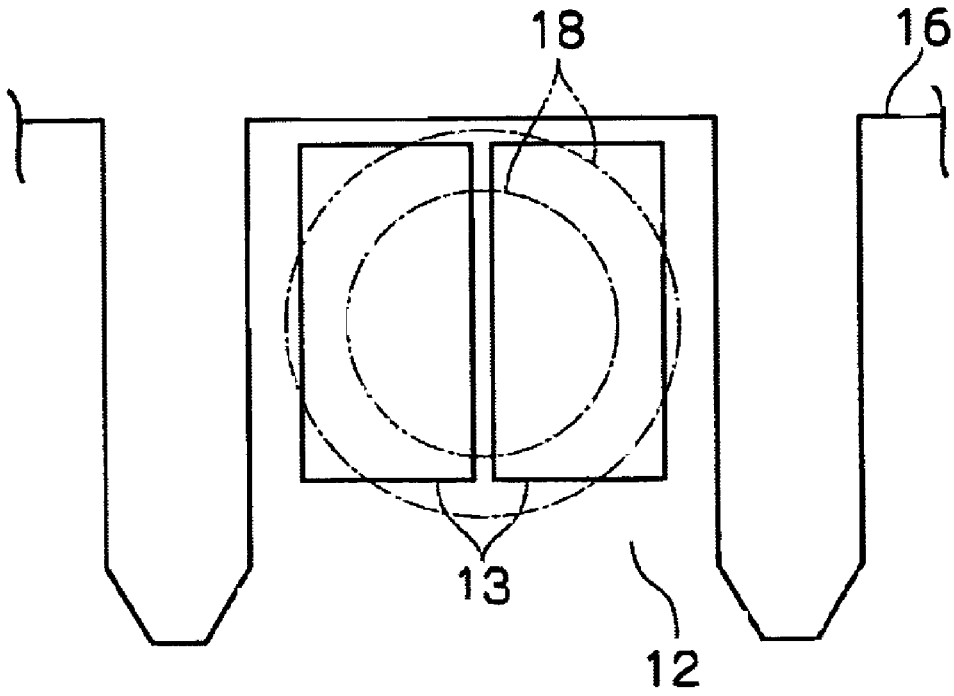
FIG. 2 includes a plan view and a side sectional view of a liquid ejection part showing the arrangement of heating elements in the liquid ejection part more in detail.
Figure 2:
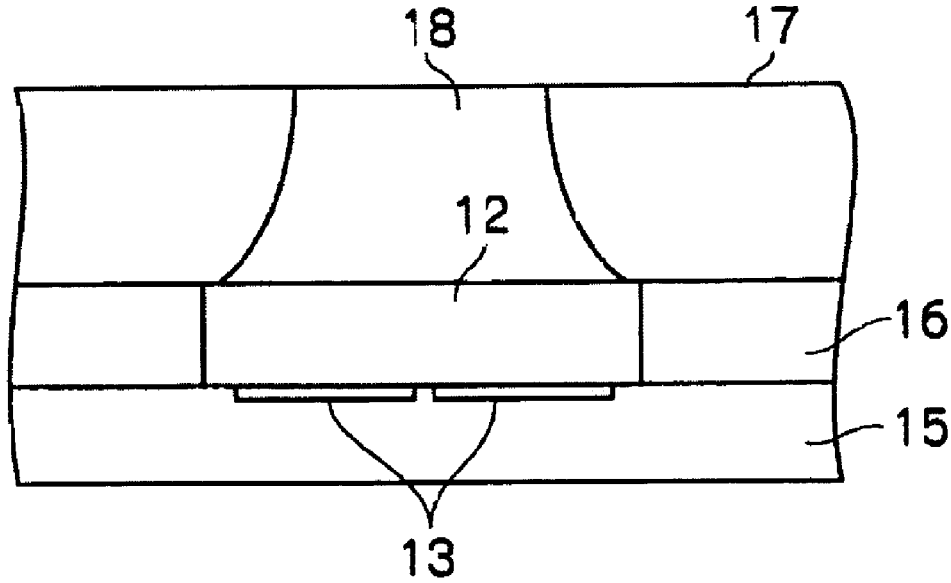

FIG. 2 includes a plan view and a sectional side elevation showing the arrangement of the heating elements 13 more in detail. In plan view of FIG. 2, the nozzle 18 is depicted by dash-dot lines. As shown in FIG. 2, according to the embodiment, within one ink chamber 12, two pieces of the heating element 13 divided into two are juxtaposed. The arrangement direction of the two pieces of the divided heating element 13 equals to that of the nozzles 18 (lateral direction in FIG. 2).

The "divided into two" does not mean only complete physical separation. In another embodiment, which will be described later, two heating elements 13 are connected to together in part. These two heating elements 13 are formed in a substantially concave shape in plan view. Electrodes are provided in both extremities of the concave shape and a central folded (inflected) portion thereof, so that the two heating elements 13 are shaped as if they were divided into two.

In the two-piece heating element 13 formed by longitudinally dividing one heating element 13 into two pieces, since the width is halved while the length is the same, the resistance value is doubled. When these two pieces of the heating element 13 are connected in series, the heating elements 13 with doubled resistance are connected in series, resulting in quadrupling the resistance value (this value is calculated without considering the distance between the juxtaposed heating elements 13).

In order to boil ink contained in the ink chamber 12, it is required to heat the heating element 13 by applying predetermined electric power to the heating element 13 because the ink is ejected by the energy during the boiling. When the resistance is small, the current must be increased; however, by increasing the resistance value of the heating element 13, the ink can be boiled with smaller current.

Thereby, a transistor for passing the current can also be reduced in size, resulting in space-saving. Reduction in thickness of the heating element 13 increases the resistance value; however, in view of the material selected for the heating element 13 and the strength (durability) thereof, the reduced thickness of the heating element 13 has a predetermined limit. Accordingly, without reducing the thickness, the resistance value is increased by dividing the heating element 13.

When the two-piece heating element 13 divided into two is provided within one ink chamber 12, the time required to reach an ink-boiling temperature (bubble generating time) by each piece of the heating element 13 is generally equalized. If a time difference between the two pieces is generated in the bubble generating time of the heating element 13, the ejecting angle of ink droplets becomes not normal, so that the ejecting direction of the ink droplets is deflected.

Figure 3:
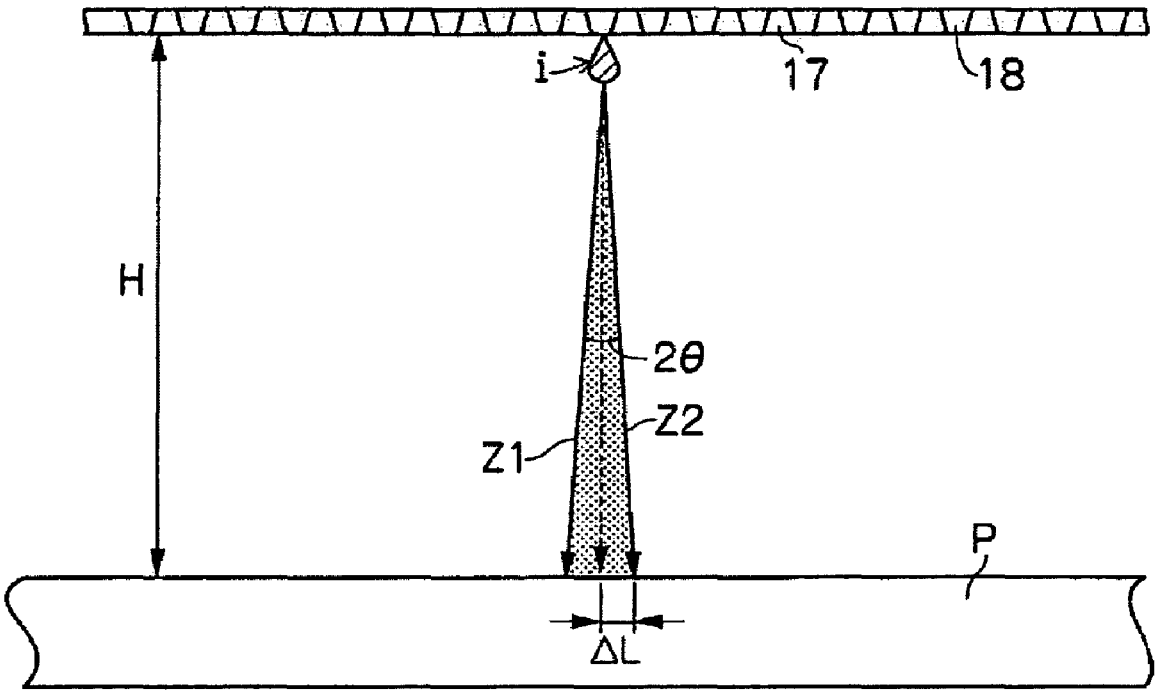
FIG. 3 is a drawing illustrating the deflection in an ejecting direction of ink droplets.

FIG. 3 is a drawing for illustrating the deflection in the ejecting direction of ink droplets. Referring to FIG. 3, when an ink droplet i is ejected normally to an ink-ejecting face of the ink droplet i, the ink droplet i is ejected without deflection. Whereas, if the ejecting direction of the ink droplet i is deflected so that an ejecting angle deviates from normal by θ (Z1 or Z2 direction in FIG. 3), the landing position of the ink droplet i is deflected by $\Delta L = H \times \tan\theta$, where H denotes the distance between the ink-ejecting face and the surface of photographic paper P.

Figure 4:
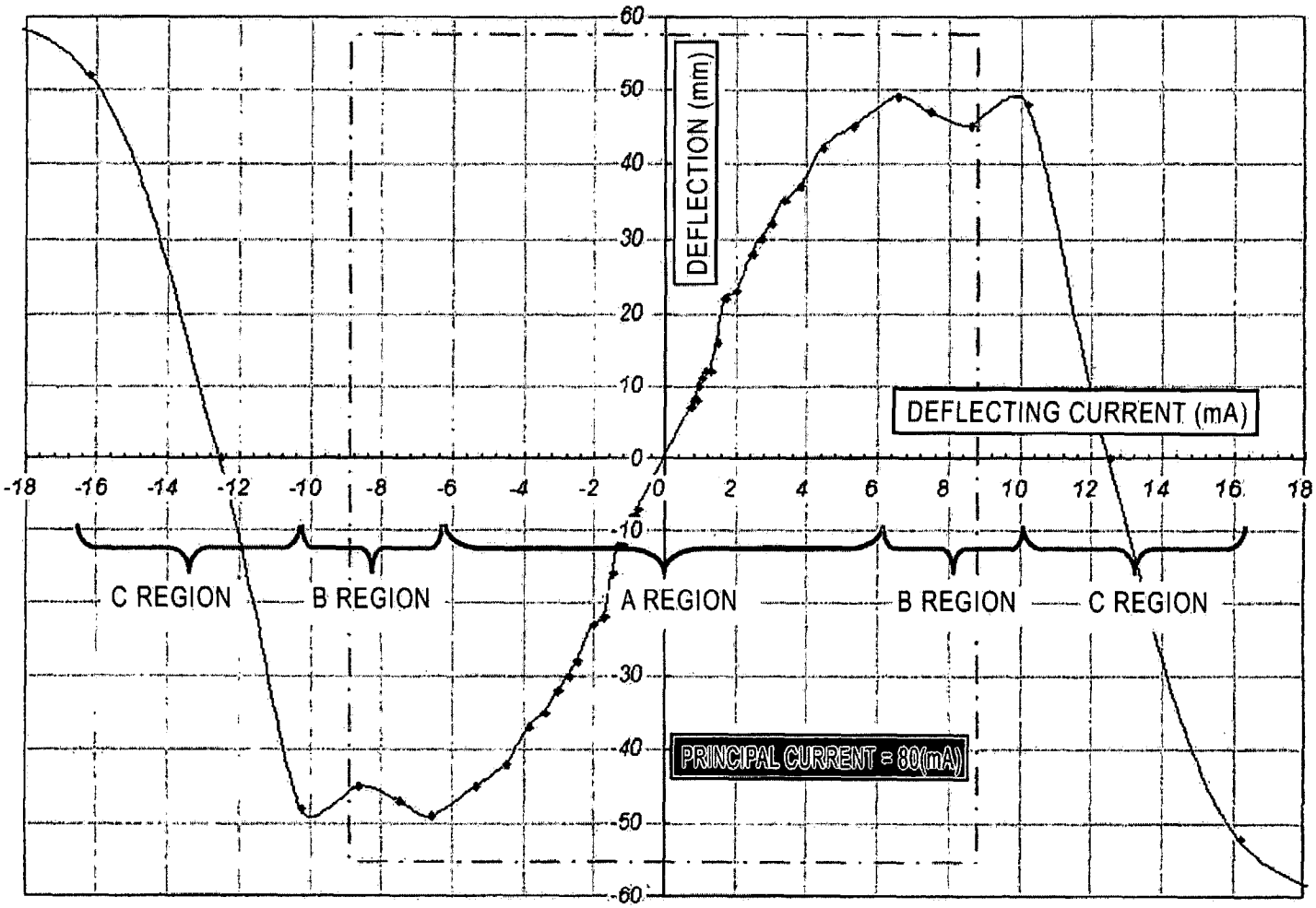
FIG. 4 is a graph of measured data showing the relationship between the bubble-generating time difference (deflection current) of the heating element divided into two pieces and the deflection of ink droplets at the landing position.

FIG. 4 is a graph showing measured data, in which half of the current difference between the two pieces of the divided heating element 13 as the bubble-generating time difference is plotted on an abscissa as a deflection current while a deflection at a landing position of an ink droplet (measured when the distance H is about 2 mm) is plotted on an ordinate. In FIG. 4, the deflected ejection of ink droplets was carried out by passing the deflection current thorough the midpoint between two pieces of the heating element 13, where the resistance value of each heating element 13 was about 75 Ω and the principal current of the heating element 13 was 80 mA.

When the time difference is produced in the bubble generation of the heating element 13 divided into two pieces in the arranging direction of the nozzles 18, as shown in FIG. 4, the landing position of the ink droplet is deflected (deviating) corresponding to the deflection current by the ejecting angle of the ink droplet deviating from normal.

Then, according to the embodiment, utilizing this characteristic, two heating elements 13 are connected in series, and a current is passed through the midpoint (or a relay point) between them so as to control for producing a time difference in the bubble generating time (generating bubbles at different times) by changing the balance of the current capacity flowing through the heating elements 13 so as to deflect the ejecting direction of ink droplets.

If resistance values of two pieces of the heating element 13 divided into two are not identical to each other because of errors in manufacturing, for example, the bubble-generating time difference is produced between the two pieces of the heating element 13, the ejecting angle of ink droplets deviates from the normal, so that the landing position of the ink droplets is deflected from their original position. However, by changing the current capacity to be applied to the divided heating element 13 so as to control the bubble-generating time of each piece of the divided heating element 13, the bubble-generating time can be matched with each other so as to make the ejecting angle of ink droplets normal.

For example, in a line head, the ejecting direction of the entire ink droplets from one or two specific heads or more is deflected from their original ejecting direction, so that the ejection direction, which is not normal to the landing surface of ink droplets of photographic paper by errors in manufacturing or the like, can be corrected so as to eject the ink droplets in a normal direction.

Also, in one head 11, the ejecting direction of the ink droplets from one or two specific liquid-ejection parts or more may be deflected. For example, in one head 11, if the ejecting direction from a specific liquid-ejection part is not parallel with that from other liquid-ejection parts, the direction from the specific liquid-ejection part can be only deflected so as to adjust it to be parallel with the ejecting direction from other liquid-ejection parts.

Furthermore, the ejecting direction of the ink droplets may be deflected as follows:

When the ink droplets are ejected from a liquid-ejection part [N] and a liquid-ejection part [N+1] which are adjacent to each other, landing positions of the ink droplets ejected from the respective liquid-ejection parts without deflection are defined as a landing position [n] and a landing position [n+1], respectively. In this case, the ink droplet from the liquid-ejection part [N] can be landed on the landing position [n] without deflection, and it can also be landed on the landing position [n+1] by deflecting it.

Similarly, the ink droplet from the liquid-ejection part [N+1] can be landed on the landing position [n +1] without deflection, and it can also be landed on the landing position [n] by deflecting it.

In such a manner, if the liquid-ejection part [N+1], for example, cannot eject the ink droplet by clogging, etc., the ink droplet could not originally be landed on the landing position [n +1], so that the head 11 would be defective due to dot missing. Whereas, in such a case, the ink droplet from another liquid-ejection part [N] or [N+2] adjacent to the liquid-ejection part [N+1] can be deflected so as to eject and land it on the landing position [n+1].

Figure 5:
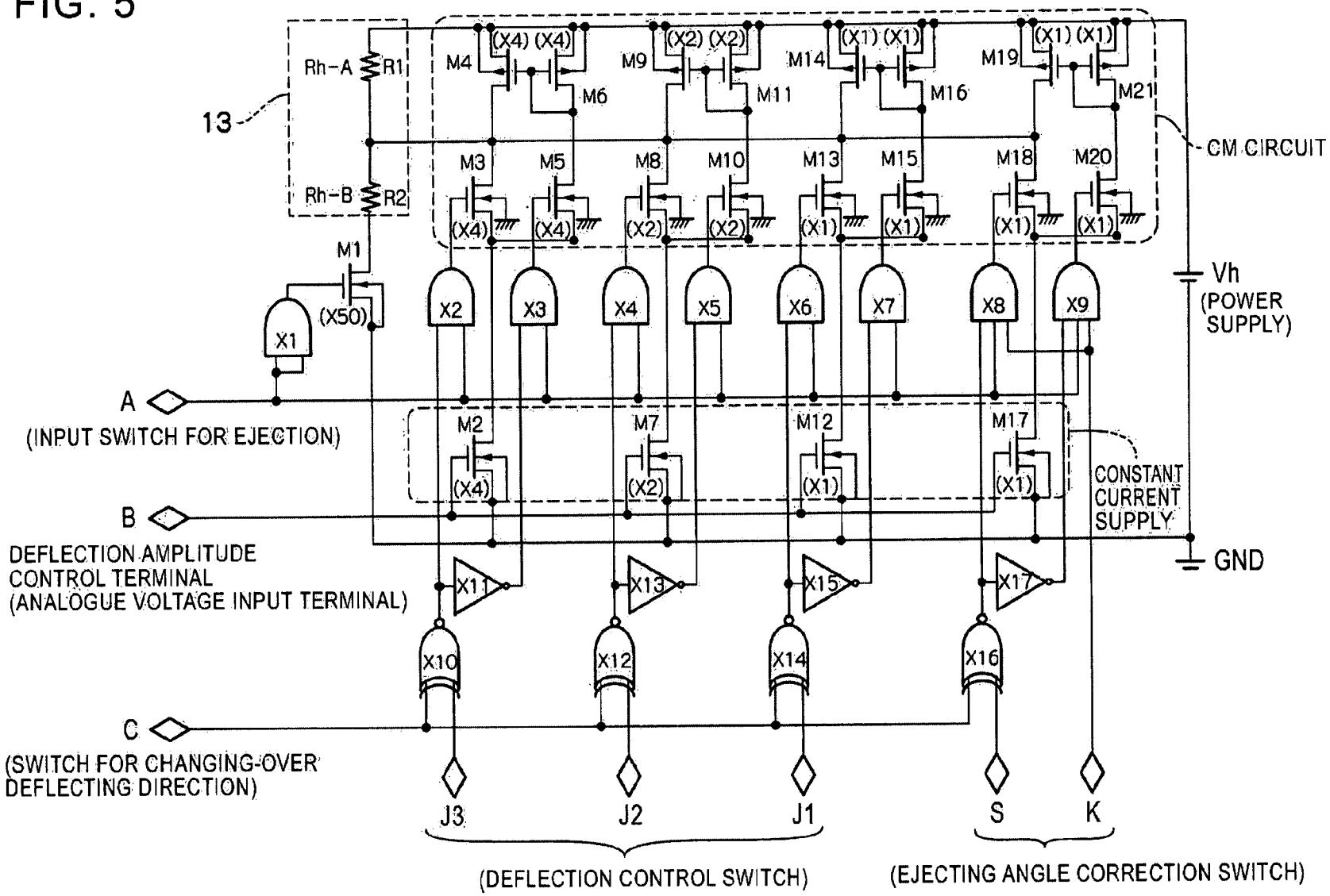
FIG. 5 is a circuit diagram of specified means for deflecting the ejecting direction of ink droplets.

FIG. 5 is a circuit diagram of an embodied technique for deflecting the ejecting direction of ink droplets. First, elements and connection states in this circuit will be described.

Referring to FIG. 5, resistances Rh-A and Rh-B are the resistances of the heating element 13 divided into two pieces and mentioned above, and both the pieces are connected in series; power supply Vh is for supplying current to the resistances Rh-A and Rh-B.

In the circuit shown in FIG. 5, there are provided transistors M1 to M21, wherein the transistors M4, M6, M9, M11, M14, M16, M19, and M21 are PMOS (P-channel metal oxide semiconductor) transistors; the other transistors are NMOS (N-channel metal oxide semiconductor) transistors; the transistors M2, M3, M4, M5, and M6, for example, constitute a set of current mirror circuit (abbreviated as a CM circuit below), so that four sets of the CM circuits are provided in total.

In the circuit, the gate and the drain of the transistor M6 are connected to the gate of transistor M4; the drains of the transistors M4 and M3 are connected to the drains of the transistors M6 and M5; these are the same as in other CM circuits.

Furthermore, the drains of the transistors M4, M9, M14, and M19 and the transistors M3, M8, M13, and M18, which constitute part of the CM circuits, are connected to a midpoint between the resistances Rh-A and Rh-B.

The transistors M2, M7, M12, and M17 are constant current sources for the respective CM circuits; the drains thereof are connected to the sources of the transistors M3, M5, M8, M10, M13, M15, M18, and M20, respectively.

Moreover, the drain of the transistor M1 is connected to the resistance Rh-B in series, and when an input switch for ejection A is turned "on", the transistor M1 is turned "on" so as to allow current to flow through the resistances Rh-A and Rh-B.

The output terminals of AND gates X1 to X9 are connected to the gates of the transistors M1, M3, M5, . . . , respectively. The AND gates X1 to X7 are two-input types while the AND gates X8 and X9 are three-input types. At least one of input terminals of the AND gates X1 to X9 is connected the input switch for ejection A.

Furthermore, the input terminal of one of XNOR gates X10, X12, X14, and X16 is connected to a switch for changing-over deflecting direction C while another input terminal is connected to deflection control switches J1 to J3 or an ejecting angle correction switch S.

The switch for changing-over deflecting direction C is for switching the ejecting direction of ink droplets in the arranging direction of the nozzles 18. When the switch for changing-over deflecting direction C is turned to be "1" (on), one input of the XNOR gate X10 is turned to be "1".

The deflection control switches J1 to J3 are for determining the deflection when the ejecting direction of ink droplets is deflected, and for example, when the input terminal J3 is turned "1" (on), one of the inputs of the XNOR gate X10 is turned to be "1".

Each output terminal of the XNOR gates X10 to X16 is connected to one input terminal of the AND gates X2, X4, . . . , while being connected to one input terminal of the AND gates X3, X5, . . . , via Not gates X11, X13, . . . . Also, one input terminal of the AND gates X8 and X9 is connected to an ejecting angle correction switch k.

Moreover, a deflection amplitude control terminal B is a terminal for determining the amplitude of a deflection "1", step, and is connected to the gates of the transistors M2, M7, . . . so as to determine the current of the transistors M2, M7, . . . , which are constant current sources of each CM circuit. If this terminal B is to be 0 V, the current of the current source becomes 0 so that the deflection current does not flow so as to make the amplitude 0. When the voltage is gradually increased so as to gradually increase the current, the deflection current is also increased for increasing the deflection amplitude.

That is, the voltage for applying an appropriate deflection-amplitude to the terminal B can be controlled. The source of the transistor M1 connected to the resistance Rh-B and the sources of the transistors M2, M7, . . . , which are constant current sources of each CM circuit, are grounded (GND).

In the above-configuration, numeral (xN (N=1, 2, 4, or 50)) attached to each of the transistors M1 to M21 in a parenthesis indicates a parallel state, so that (x1) (M12 to M21) shows a standard element; (x2) (M7 to M11) shows an element equivalent to two standard elements connected in parallel, for example. Numeral (xN) below represents a component equivalent to N standard elements connected in parallel.

In such a manner, (x4), (x2), (x1), and (x1) are attached to the transistors M2, M7, M12, and M17, respectively, so that when an appropriate voltage is applied to between the gate and ground of each of these transistors, a ratio of 4:2:1:1 is shown in the respective drain currents.

Next, the operation of this circuit will be described by noting only the CM circuit composed of the transistors M3, M4, M5, and M6 at first.

The input switch for ejection A is turned (ON) "1" only when ink is ejected.

For example, when A="1", B=2.5 V applied, C="1", and j3="1", the output of the XNOR gate X10 is to be "1", so that this output "1" and A="1" are entered to the AND gate X2 so that the output of the AND gate X2 becomes "1". Hence, the transistor M3 is turned ON.

Also, when the output of the XNOR gate X10 is "1", the output of the NOT gate X11 is "0", this output "0" and A="1" become the input of the AND gate X3 so that the output of the AND gate X3 becomes "0", and the transistor M5 is turned OFF.

Hence, since both the drains of the transistors M4 and M3, and both the drains of the transistors M6 and M5 are connected together, respectively, when the transistor M3 is turned ON and the transistor M5 is turned OFF as mentioned above, the current flows from the transistor M4 to the transistor M3 while the current does not flow from the transistor M6 to the transistor M5. When the current does not pass through the transistor M6 because of characteristics of the CM circuit, the current also does not pass through the transistor M4. Since a voltage of 2.5 V is applied to the gate of the transistor M2, the current corresponding to this situation flows only from the transistor M3 to the transistor M2 among the transistors M3, M4, M5, and M6 in the case mentioned above.

In this state, since the gate of M5 is OFF, the current does not flow through M6, and also does not flow through M4 which is a mirror of M6. Through the resistances Rh-A and Rh-B, the same current flows originally; when the gate of M3 is turned ON, in order to derive the current value determined in M2 from the midpoint between the resistances Rh-A and Rh-B, the current value determined in M2 is added to the Rh-A side while being subtracted from the Rh-B side.

Accordingly, the resistances become |Rh-A>|Rh-B.

The above case is when C="1", and then in the case when C="0", i.e., the case where only the input of the switch for changing-over deflecting direction C is different (other switches A, B, and j3 are to be "1" as mentioned above), the state will be as follows:

When C="0" and j3="1", the output of the XNOR gate X10 is to be "0". Accordingly, the input of the AND gate X2 is to be ("0", "1" (A="1")), so that the output thereof is to be "0". Hence the transistor M3 is turned OFF.

If the output of the XNOR gate X10 is to be "0", the output of the NOT gate X11 is to be "1", so that the input of the AND gate X3 is to be ("1", "1" (A="1")), turning ON the transistor M5.

When the transistor M5 is turned ON, the current flows through the transistor M6, so that the current flows also through the transistor M4 as well as by means of characteristics of the CM circuit.

Hence, from the power supply Vh, the current flows through the resistance Rh-A, the transistor M4, and the transistor M6. Then, the entire current passed through the resistance Rh-A flows through the resistance Rh-B (since the transistor M3 is OFF, the current passed through the resistance Rh-A does not branch to the transistor M3). The entire current passed through the transistor M4 flows toward the resistance Rh-B because the transistor M3 is OFF. Furthermore, the current passed through the transistor M6 flows to the transistor M5.

As described above, when C="1", the current passed through the resistance Rh-A flows to branch to the resistance Rh-B and to the transistor M3; whereas when C="0", in addition to the current passed through the resistance Rh-A, the current passed through the transistor M4 enters the resistance Rh-B. As a result, the currents flowing through the resistances Rh-A and Rh-B are 1Rh-A<1Rh-8. The ratio thereof is symmetrical at C="1" and C="0".

In such a manner that the currents flowing through the resistances Rh-A and Rh-B are balanced, the bubble-generation time difference can be provided on the heating element 13 divided into two pieces. The ejecting direction of ink droplets can be thereby deflected.

Also, by means of C="1" and C="0", the deflecting direction of ink droplets can be switched to a symmetrical position in the arranging direction of the nozzles 18.

In the above description, only the deflection control switch j3 is in an ON/OFF state; however, if deflection control switches J2 and J1 are further turned ON/OFF, the current for allowing to flow through the resistances Rh-A and Rh-B can be established more in detail.

That is, while the deflection control switch j3 can control the current flowing through the transistors M4 and M6, the deflection control switch j2 can control the current flowing through the transistors M9 and M11. Furthermore, the current flowing through the transistors M14 and M16 can be controlled by the deflection control switch j1.

As described above, to each transistor, a drain current with a ratio of 4:2:1 between the transistors M4 and M6, M9 and M11, and M14 and M16 can be supplied. Accordingly, the deflecting direction of ink droplets can be varied in eight steps that (j1, j2, j3)=(0, 0, 0), (0, 0, 1), (0, 1, 0), (0, 1, 1), (1, 0, 0), (1, 0, 1), (1, 1, 0), and (1, 1, 1), using three bits of the deflection control switch j1.

Furthermore, changing the voltage applied between the gates of the transistors M2, M7, M12, and M17 and the ground can vary the current capacity, so that the deflection amount per one step can be changed while the ratio of the drain current flowing through each transistor is to be 4:2:1 as it is.

Moreover, as described above, by means of the switch for changing-over deflecting direction C, the deflecting direction can be switched symmetrically about the arranging direction of the nozzles 18.

In the line head, a so-called staggered arrangement is sometimes used in that a plurality of the heads 11 are arranged in the width direction of photographic paper while the adjacent heads 11 oppose each other (the head 11 is rotated by 180° relative to the adjacent head 11). In this case, when a common signal is supplied to the two heads 11 adjacent to each other from the deflection control switches j1 to j3, the deflecting direction is reversed in the two heads 11 adjacent to each other. Thus, according to the embodiment, the switch for changing-over deflecting direction C is provided so that the deflecting direction of the entire of one head 11 can be switched symmetrically.

Thus, when a plurality of the heads 11 are arranged in the staggered arrangement, among the heads 11, the heads 11 arranged at even-numbered positions N, N+2, N+4, . . . are established in C="0", while the heads 11 arranged at odd-numbered positions N+1, N+3, N+5 . . . are established in C="1", the heads 11 in the line head can be directed in a predetermined direction.

Also, ejecting angle correction switches S and K are similar to the deflection control switches j1 to j3 in view of switches for deflecting the ejecting direction of ink droplets; however, they are switches for correcting the ejecting angle of ink droplets.

First, the ejecting angle correction switch K is a switch for determining whether correction is performed, such that it is established that the correction is performed in K="1" while is not performed in K="0".

Also, the ejecting angle correction switch S is a switch for determining in which direction the correction is carried out relative to the arranging direction of the nozzles 18.

For example, when K="0" (correction is not performed), among three inputs of the AND gates X8 and X9, one input becomes "0", so that both the outputs of the AND gates X8 and X9 are to be "0". Hence, the transistors M18 and M20 are turned OFF, so that the transistors M19 and M21 are also turned OFF, thereby not changing the current flowing through the resistances Rh-A and Rh-B.

Whereas, when K="1", if S="0", and C="0", for example, the output of the XNOR gate X16 becomes "1". Thus, in the AND gate X8, (1, 1, 1) is entered, so that the output thereof becomes "1", turning the transistor M18 ON. One of inputs of the AND gate X9 becomes "0" through the Not gate X17, so that the output of the AND gate X9 becomes "0", turning the transistor M20 OFF. Hence, the current does not flow through the transistor M21 because the transistor M20 is in the OFF state.

By means of characteristics of the CM circuit, the current does not flow also through the transistor M19. Whereas the transistor M18 is ON, the current flows out of the midpoint between the resistances Rh-A and Rh-B so as to enter the transistor M18. Hence, the current flowing through the resistance Rh-B can be reduced smaller than the resistance Rh-A, thereby correcting the ejecting angle of ink droplets so as to correct the landing position of the ink droplets by a predetermined displacement in the arranging direction of the nozzles 18.

According to the embodiment, the correction is carried out by two bits of the ejecting angle correction switches S and K; if the number of the switches is increased, the correction can be performed more in detail.

When deflecting the ejecting direction of ink droplets using each of the switches j1 to j3, S, and K, the current (a deflecting current Idef) is expressed by Equation (1):

$$Idef=j3\times4\times1s+j2\times2\times1s+j1\times1s+S\times K\times1s=(4\times j3+2\times j2+j1+S\times K)\times1s \quad (1)$$

In Equation (1), +1 or −1 is given to j1, j2, and j3; +1 or −1 to S; and +1 or 0 to K.

As is understood from Equation (1), by the establishment of j1 to j3, the deflecting current can be set in steps while by means of S and K, correction can be performed independently of the establishment of j1 to j3.

Since the deflecting current can be set in four steps for a positive value and in four steps for a negative value, the deflecting direction can be set in both arranging directions of the nozzles 18. For example, in FIG. 3, the ejecting angle can be deflected by θ about the normal line in the left (the Z1 direction in the drawing) while can be deflected by θ about the normal line in the right (the Z2 direction in the drawing). Moreover, the value of θ, i.e. the deflection amount, can be arbitrarily set.

Next, phenomena when ink droplets are ejected with deflection will be described in more detail.

FIGS. 6A to 6D are sectional views of one liquid-ejection part sequentially showing from the state that the heating element 13 is before being heated to the state that ink droplets are ejected after the element 13 is heated.

(A) Static State

The current does not flow through the heating element 13. In this state, the heating element 13 is not heated. The ink chamber 12 and the nozzles 18 are filled with ink. On the ink-ejection surface of the nozzle 18, a meniscus (ink level) is formed, which is downward concave because the ink chamber 12 is maintained in internal pressure lower than atmospheric pressure.

(B) Heated and Bubble-generation State

This is a state that the heating element 13 is rapidly heated. In this case, ink in contact with the heating element 13 is heated at a temperature exceeding a normal boiling point. Because the top layer of the heating element 13 is thin, the ink is sharply boiled (film boiling state). Also, this state is at a moment of boiling initiation so that the volume of bubbles generated on the heating element 13 is small and a pressure applied to the ink is also small.

(C) Bubble-growing and Ink Droplets-generating State

Energy supply to the heating element 13 is set to stop just before the bubble generation. Thus, when energy is once supplied to the heating element 13, the liquid-ejection part changes from "(B) Heated and Bubble-generation State" to "(C) Bubble-growing and Ink droplets-generating State", and at this time, the energy supply to the heating element 13 has been already stopped.

This is for preventing the damage of the heating element 13 due to rapid increase in temperature because after the bubble generating, the heating element 13 does not come in contact with ink. However, the heating element 13 is at a considerable high temperature due to after-heat at this time.

In the "(C) Bubble-growing and Ink droplets-generating State", the vicinity of the generated bubbles is surrounded by the ink with a temperature far exceeding its boiling point, so that the boiling continues actively from the ink surface contacting the bubbles. While the ink surface is rapidly inflated, evaporation heat takes the heat away. When bubbles generated by two heating elements 13 grow, the two bubbles are assumed to unite together when they are brought into contact with each other. Even when the inside of the bubble becomes below the atmospheric pressure by the further bubble growing, the inflation is continued by an inertial force due to the initial bubble inflation.

(D) Bubble-shrinking and Ink Droplets-separation State

This is a state of the bubbles initiating shrinkage rapidly with a pressure reduced lower than the atmospheric pressure by the rapid bubble inflation because heat is absorbed by the evaporation heat. By the reduction in pressure, a force is applied to ink to draw it inside so as to balance the above-mentioned inertial force (flying force of the ink droplet to dash out). As a result, the ink droplet flies as shown in the drawing.

Then, since heat is discharged outside by the flying bubbles, the temperature within the ink chamber 12 decreases so that the negative pressure is increased by the shrinkage of bubbles. By the negative pressure, new ink (ink with the same volume as that of the flying-out ink droplets) flows into the chamber from the passage. As a result, the bubbles shrink further so as to vanish before long.

Also, a meniscus, which is at a level reduced considerably lower than usual by a surface tension applied to an orifice (internal edge of the ejection face of the nozzle 18) due to the flying of ink droplets, is gradually returned to the initial state with increasing supply of ink within the ink chamber 12.

Incidentally, the above-description is the case where bubbles are simultaneously generated from the two heating elements 13; whereas when the bubble generating timing in the two heating elements 13 is different, the ejecting direction of ink droplets is deflected.

FIGS. 7A to 7F are sectional views of one liquid-ejection part sequentially showing from the state that the heating element 13 is before being heated to the state that ink is ejected after the element is heated. In FIGS. 7A to 7F, the case that heating element 13 on the right generates bubbles ahead is exemplified.

(A) Static State

Figure 6A:
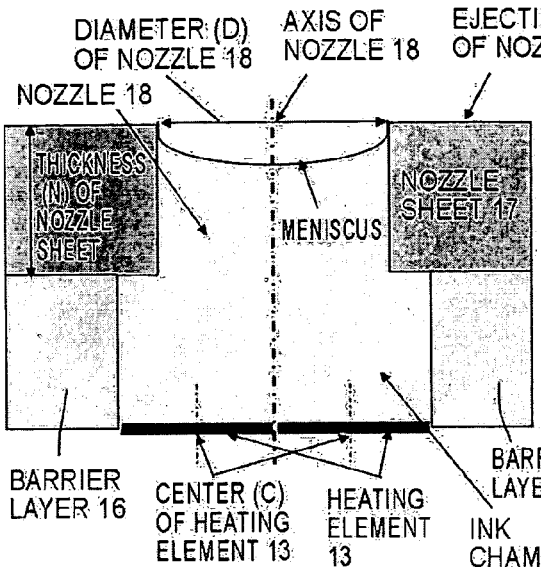
FIGS. 6A to 6D are sectional views of one liquid ejection part sequentially showing the states of the heating element from before being heated to ink droplets are ejected after being heated.
Figure 6B:
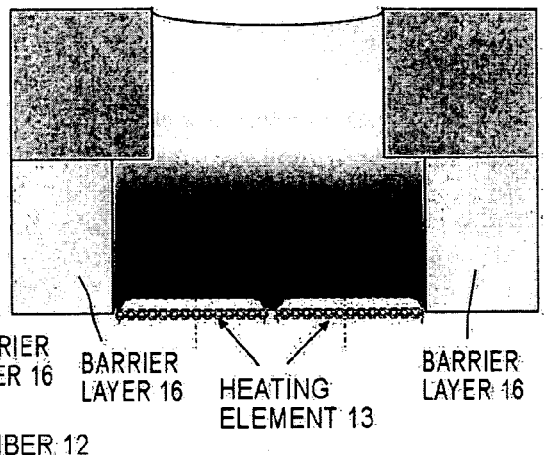
Figure 6C:
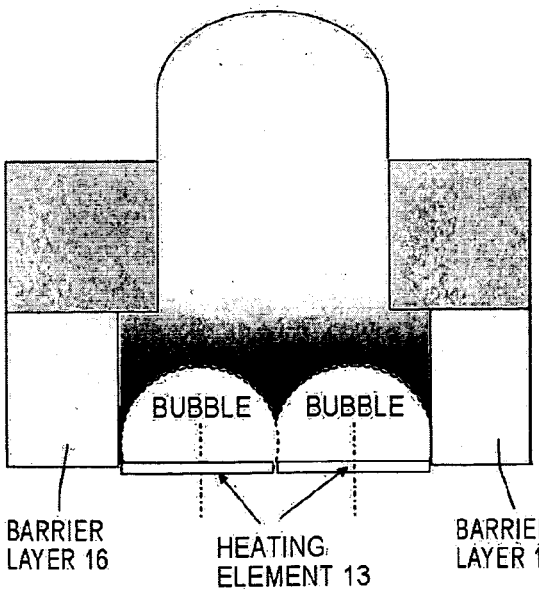
Figure 6D:
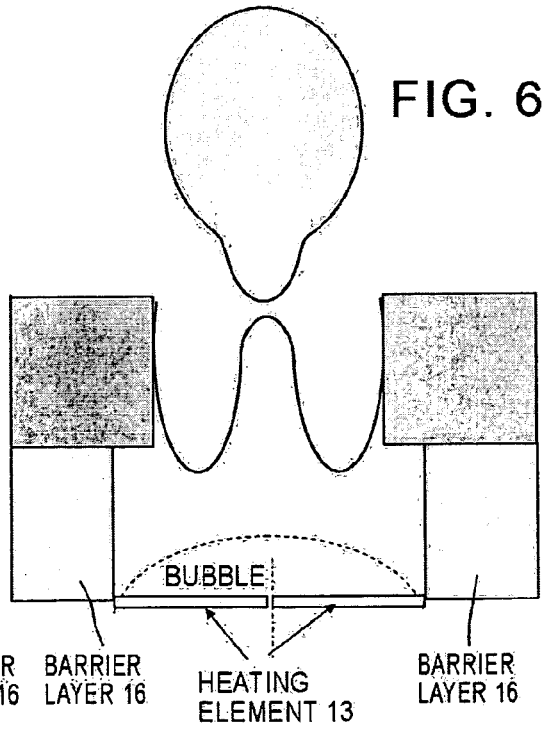

As this is the same as in "(A) Static State" in FIG. 6A, description is omitted.

(B) Heated and Bubble-generation State

In this state, an example is shown in that a bubble is first generated on the heating element 13 on the right in the drawing so as to proceed toward film boiling. Since the boiling has just started in this state, the volume of the entire generated bubble is small and the bubble is stuck on the surface of the heating element 13 so that the pressure applied to the ink arranged thereon is yet small.

(C) Bubble-growing and Ink Droplets-generating State

In the drawing, the bubble of the right heating element grows from the (B) state. On the other hand, on the heating element 13 arranged on the left in the drawing, a bubble is also generated so as to be film boiling. Since the timing at which the two heating elements 13 approach the boiling point is different, a flying force is applied to ink droplets to be ejected from the nozzle 18 in a slanting direction (upward to the left in the drawing). That is, this is because by the pressure of the bubble generated on the right heating element 13, a vector is applied along a line connecting between the center of the right heating element 13 and the center of the nozzle 18 on the ejection face thereof.

That is, in the above-mentioned example, if bubbles were simultaneously generated on the two heating elements 13, the flying force direction of ink droplets would agree with the axial direction of the nozzle.

Whereas, when the timing of bubble-generating on the two heating elements 13 is different, the flying force direction of ink droplets does not agree with the axial direction of the nozzle. Although the principal component of the flying force of ink droplets is directed to agree with the axial direction of the nozzle 18, there is another component in a direction perpendicular to the above direction, i.e. a direction parallel to the ejection face of the nozzle 18.

This force component parallel to the ejection face of the nozzle 18 is for deflecting ink droplets. This force is assumed to produce when bubbles are generated on the heating element 13 on one side before the direct force for ejecting ink droplets (force in an axial direction of the nozzle 18) is sufficiently developed.

In order to control to differentiate the bubble generating time on the two heating elements 13, the same energy may be applied to the respective heating elements 13 with time difference. However, as shown in the circuit of FIG. 5, it is preferable and efficient in design that energy be applied to the two heating elements 13 simultaneously (at the same time), while energy with different surface densities be applied thereto, so as to control to differentiate the bubble generating time (by film-boiling) on the two heating elements 13.

The amount of energy per unit area (energy surface density) is expressed as follows:

$$J/s \cdot m^2 = W/m^2$$

where the unit of energy is joule (J) and the unit of energy per unit time is watt (W).

As described above, by controlling to differentiate the bubble generating time on the two heating elements 13, a flying force with a component parallel to the ejection face of the nozzle 18 can be controlled for applying it to ink droplets in the generating process of ink droplets.

Furthermore, by changing the difference between energy surface densities applied to the two heating elements 13, the landing position of ink droplets can be varied (i.e., the deflection is changed) by varying the component parallel to the ejection face of the nozzle 18 among the flying force of ink droplets.

(D) Bubble Growing and Unitized State

In this state, bubbles are unitized into one when their ends come in contact with each other on both the heating elements 13. By the force applied to the initial meniscus, the same force as that in State (C) is applied to ink droplets, which are to be ejected from the nozzle 18.

(E) Bubble-shrinking and Ink Droplets-separation State

Since the period of time for the energy applied to the heating element 13 as described above is short (about 1.5 μs according to the embodiment), the bubble growing is also finished within a short time. Because the almost entire applied heat is carried away by evaporation heat and ink droplets, the bubbles shrink rapidly. Furthermore, in the same way as that described above, the initially applied flying force of ink droplets repulses the force during bubble shrinking, so that part of ink is separated from the ink droplets so as to withdraw (ejection).

(F) Bubble-vanishing and Ink-replenished State

The ink droplets separated from the nozzle 18 fly. Within the ink chamber 12, while the bubbles vanish, extreme negative pressure is applied just after ejection of the ink droplets so that ink is replenished from the passage.

As described above, with bubble-generating time difference on the two heating elements 13, ink droplets are ejected to deviate from the axial line of the nozzle 18.

Consequently, the relationship between the bubble-generating time difference and the ejecting direction of ink droplets will be described.

The above-description is regarding to the operation in "A region" in FIG. 4. That is, with increasing deflection current to be applied to the two heating elements 13 (difference in energy to be applied to the two heating elements 13), the deflection (the deflection in the arranging direction of the two heating elements 13 produced between the intersection of a recording medium surface and the axis of the nozzle 18 and the landing position of ink droplets) has been increased (substantially in proportion to each other).

Whereas, in "B region" and "C region" in FIG. 4, such relationship is not established. For example, in "C region", the rate of change in deflection with the deflection current is about two times that of "A region". The reason of such behavior will be described below.

Figure 8:
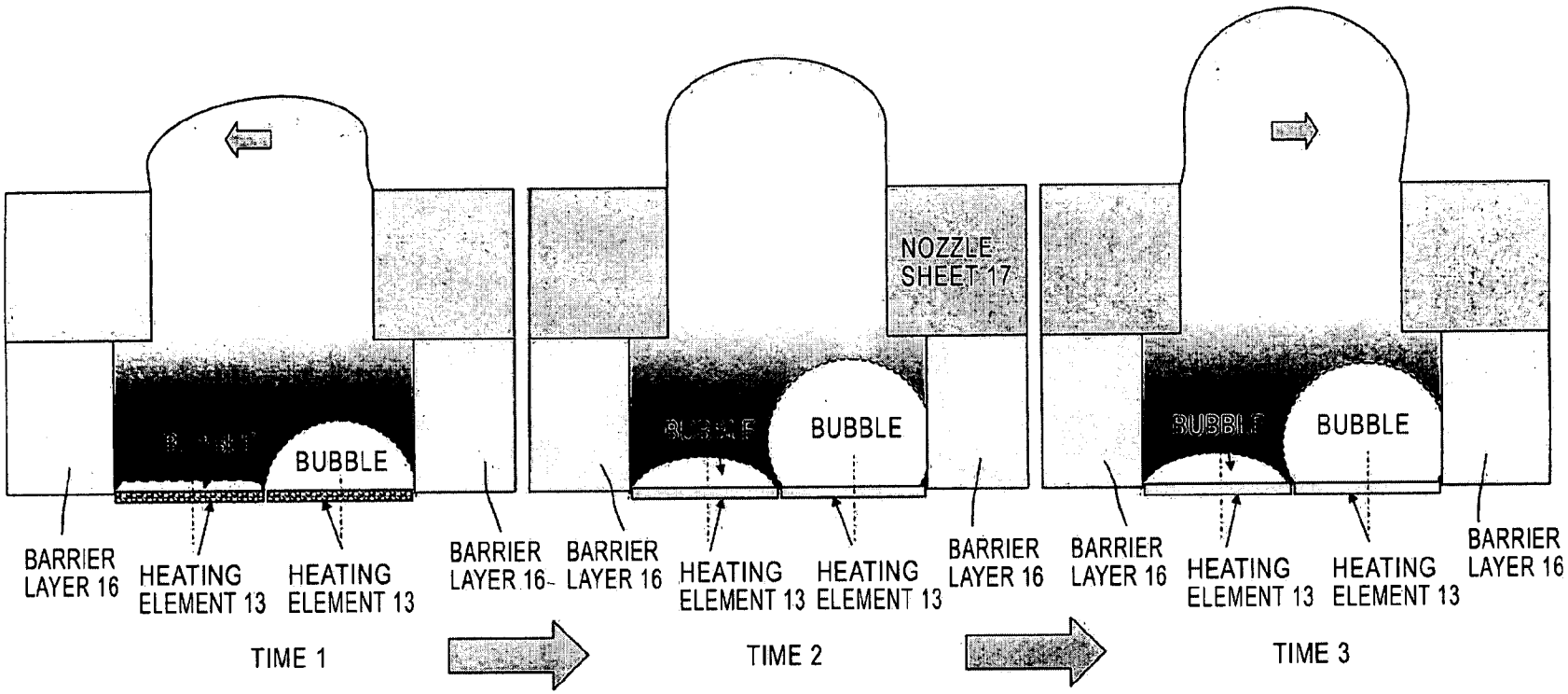
FIG. 8 is a drawing for schematically illustrating why ink droplets are ejected in an opposite direction when the energy difference applied to the heating element is increased larger than that in region A.

FIG. 8 is a schematic presentation for illustrating the reason why ink droplets are ejected in an opposite direction if the energy difference applied to the heating element 13 increased larger than that in "A region". In FIG. 8, situations are sequentially shown from the left to the right in process of time, and portions where a force direction is changed are only shown.

(1) Time 1 (Operation in "A Region" in FIG. 4)

Referring to FIG. 8, Time 1 is a case where the bubble-generating time difference is applied in the same way as that of FIGS. 7A to 7F (case of "A region"), and the bubble-generating time on the right heating element 13 is earlier than that on the left. In this case, with growing bubble, a meniscus is raised from the right side of the ejection face of the nozzle 18 in the drawing, and for leveling the meniscus, a surface tension is applied to the left. Then, ink droplets are ejected by a flying force with a component in the left direction in parallel to the ejection face of the nozzle 18.

Also, the ink protruded from the ejection face of the nozzle 18 is assumed to laterally vibrate, and is gradually attenuated by the viscosity resistance of the ink.

(2) Time 2 (Operation in "C Region" in FIG. 4 where the Deflection=0)

When the energy difference between the heating elements 13 is larger than that in "A region", the subsequent bubble has not be developed for ejecting. During the development of the subsequent bubble, the ink surface pushed out of the nozzle 18 by the advance bubble is moved to vibrate. This is a moment at which the phase of the vibration is located at the same position as that without deflection.

(3) Time 3 (Operation in the Right of "C Region" in FIG. 4 from where the Deflection=0)

This is a case where the phase of the vibration further proceeds to have a direction opposite to that of Time 1 (to have a right vector in the drawing) after passing through the point at which the deflection=0, and at this moment, ink droplets are ejected.

As described above with reference to FIG. 4, changes in the deflection with changes in the deflecting current are different in "A region", "B region", and "C region". Then, the deflection can be changed using the functions of these regions.

Figure 9:
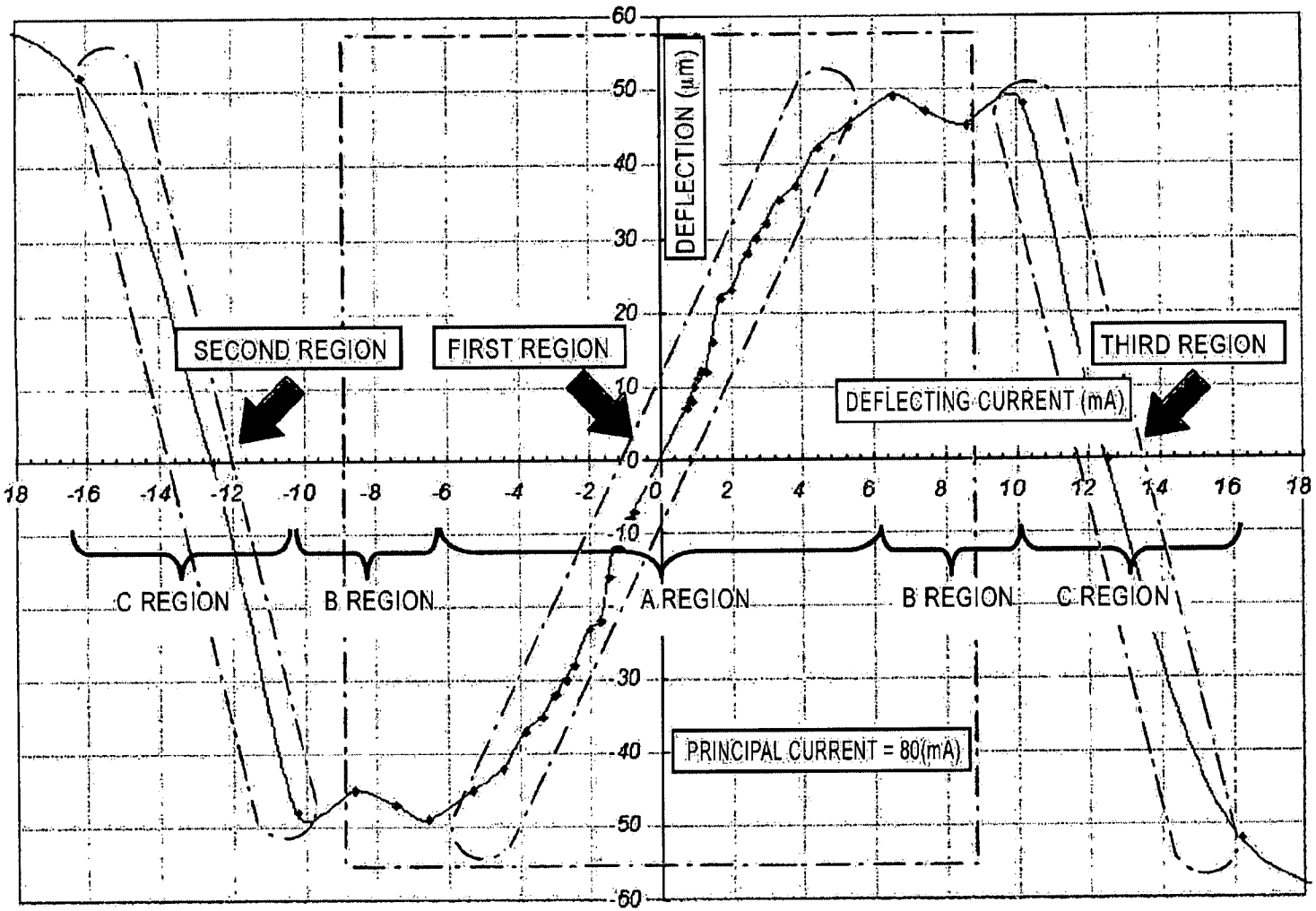
FIG. 9 is a graph incorporating a first region, a second region, and a third region into the graph of FIG. 4.

FIG. 9 is a graph in that a first region, a second region, and a third region (ranges surrounded by dash-dotted lines) are added to FIG. 4.

In the graph of FIG. 9 (the range entirely including the first to third ranges), when an original point is defined to be a point where energy surface-density difference between the two heating elements 13 is zero and the component of the flying force of ink droplets parallel to the ejection face of the nozzle 18 is zero (the deflecting current=0 mA in abscissa of the graph in FIG. 9), with increasing difference between energy surface densities, the component of the flying force of ink droplets parallel to the ejection face of the nozzle 18 increases so as to have a peak value, then it decreases.

The first range is a range where the component of the flying force of ink droplets parallel to the ejection face of the nozzle 18 increases toward the peak value around the original point with increasing difference between energy surface densities.

The second range adjacent to the first range is a range where the component of the flying force of ink droplets parallel to the ejection face of the nozzle 18 changes to the peak value and including appoint where with decreasing energy surface-density difference between the two heating elements 13, the component of the flying force of ink droplets parallel to the ejection face of the nozzle 18 becomes zero (the point passing the vicinity where the deflecting current=−12.5 mA in abscissa of the graph in FIG. 9).

Furthermore, the third range is adjacent to the first range and is symmetrical with the second range about the point where the energy surface-density difference between the two heating elements 13 is zero so as to have the relationship obtained by inverting conditions of energy applied to the two heating elements 13 in the second range. This is a range where with increasing energy surface-density difference between the two heating elements 13, the component of the flying force of ink droplets parallel to the ejection face of the nozzle 18 changes after the peak value and including a point where with increasing energy surface-density difference between the two heating elements 13, the component of the flying force of ink droplets parallel to the ejection face of the nozzle 18 becomes zero (the point passing the vicinity where the deflecting current=+12.5 mA in abscissa of the graph in FIG. 9).

In these three ranges, in any one of them, by changing the difference between energy surface densities applied to the two heating elements 13, the component of the flying force of ink droplets parallel to the ejection face of the nozzle 18 may be controlled to change its value.

In these three ranges, within a plurality of the ranges, by changing the difference between energy surface densities applied to the two heating elements 13, the component of the flying force of ink droplets parallel to the ejection face of the nozzle 18 may also be controlled to change its value.

Figure 10:
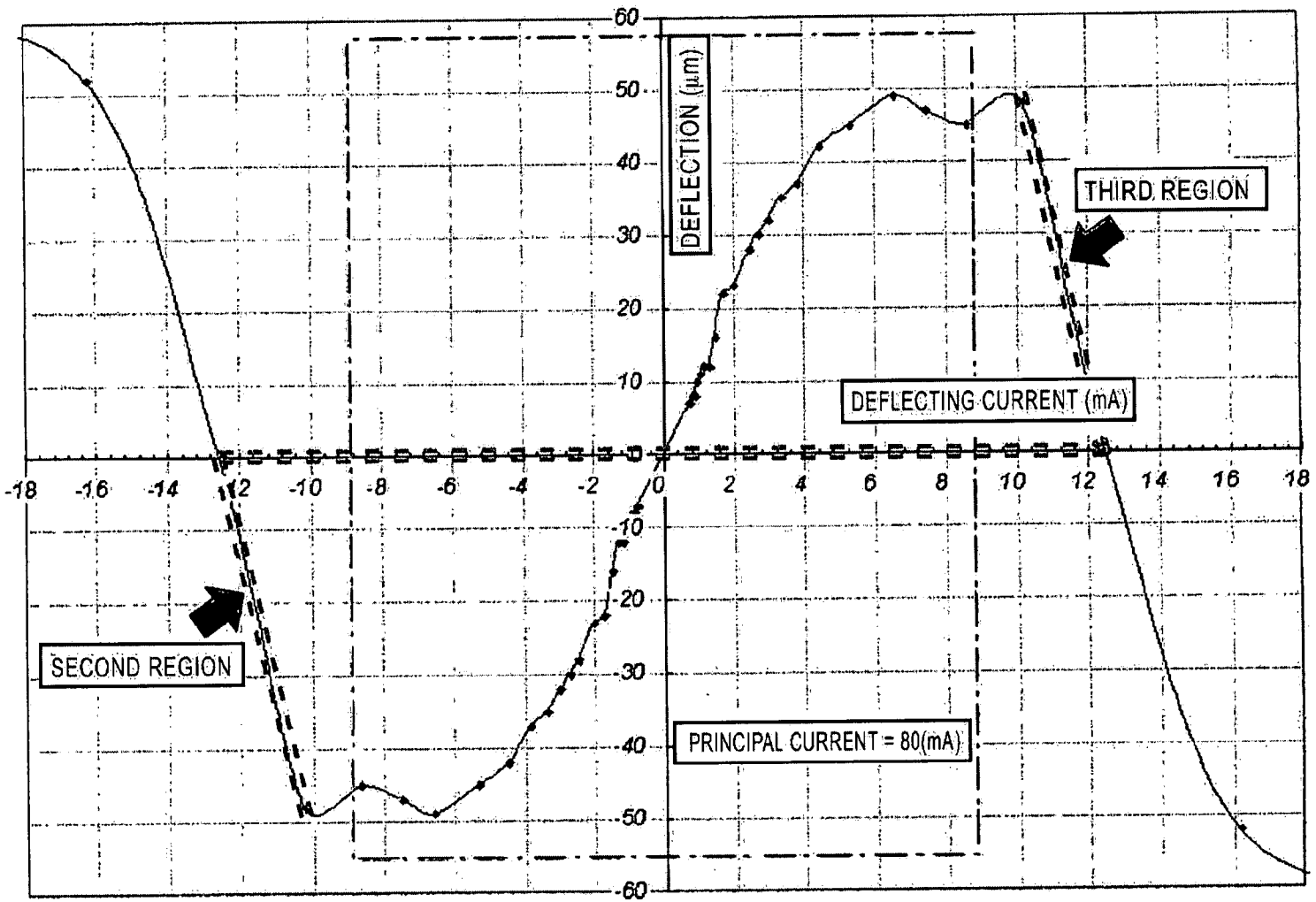
FIG. 10 is a graph for showing the deflection control using both a range where the deflection is negative in the second region and a range where the deflection is positive in the third region.

For example, FIG. 10 shows a case where the deflection is controlled using both the range in that the deflection is negative in the second range and the range in that the deflection is positive in the third range (shown by double broken lines in the drawing).

Figure 11:
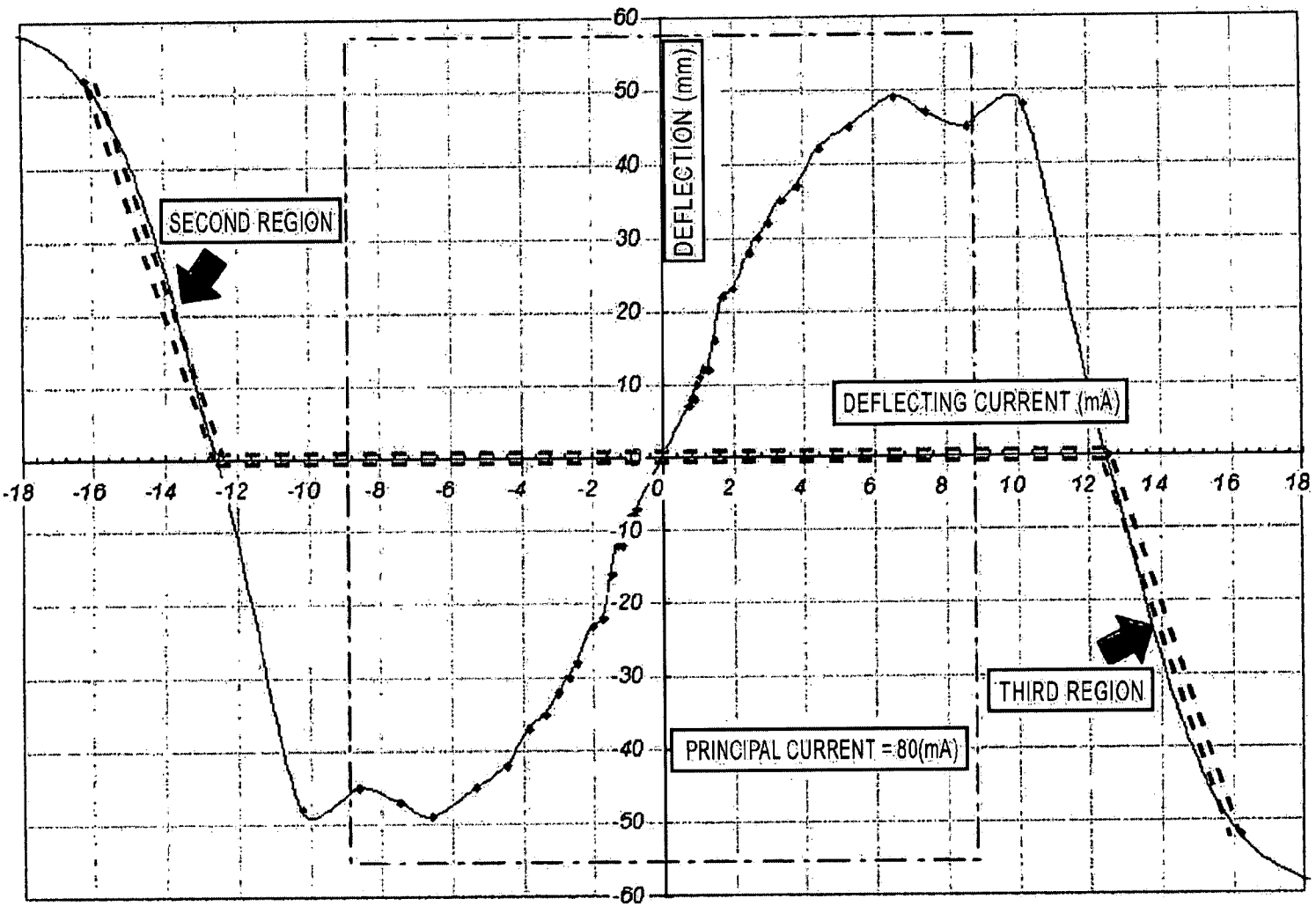
FIG. 11 is a graph for showing the deflection control using both a range where the deflection is positive in the second region and a range where the deflection is negative in the third region.

FIG. 11 shows a case where the deflection is controlled using both the range in that the deflection is positive in the second range and the range in that the deflection is negative in the third range (shown by double broken lines).

In such a manner, the deflection may be controlled using any of the ranges.

However, if only the first range is used, the control can be carried out within the range where the absolute value of the deflection current is small (the absolute value is half to one third of those of the other two ranges), so that it is preferable to practically use the first range in view of power consumption and kogation.

However, in view of satellite characteristics (during ejection of ink droplets, a rearward extending tail portion of the ink droplet is ejected as a small ink droplet different from ink droplets during ejection), since the satellite is smaller in the second and third ranges than in the first range upon carrying out experiments, using the second or third range is significant.

Next, the deformation of the nozzle sheet 17 during ejection of ink droplets will be described.

It is also assumed that deformations of the nozzle sheet 17 and the barrier layer 16 be negligible because they are small as substantial rigid bodies even when pressure due to ejecting operation is applied thereto.

Figures 12A, 12B, 12C:
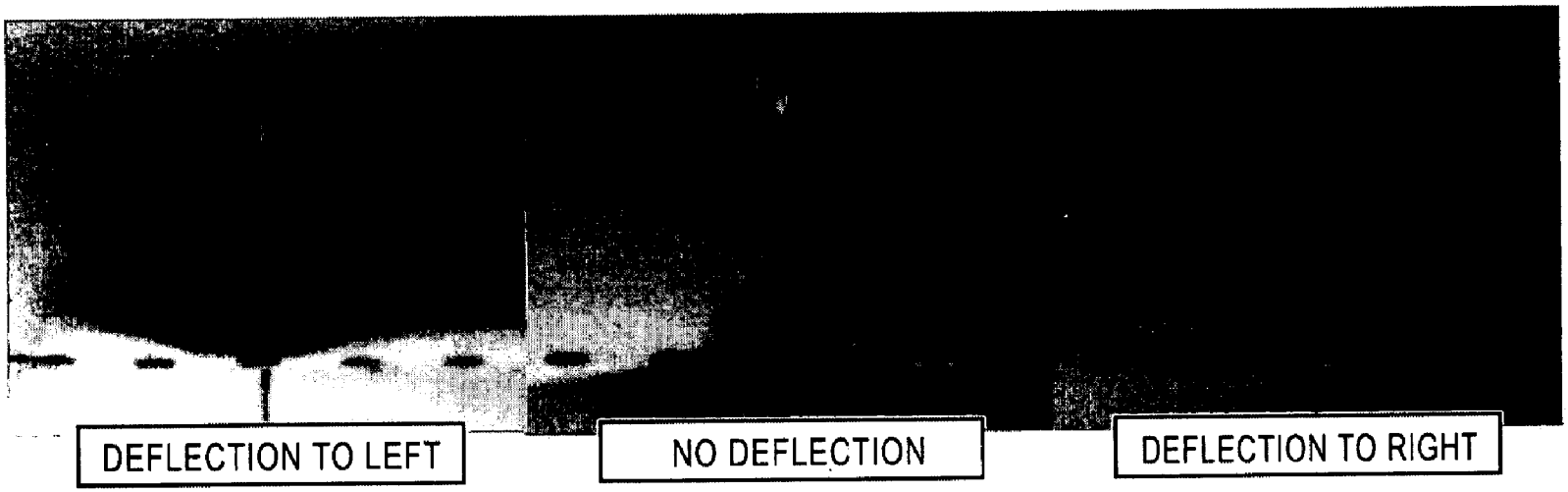
FIGS. 12A to 12*c* are drawings showing pictures of moments in that ink droplets are actually ejected.

However, in practice, it has been understood that very high pressure is applied to these parts so that the deformations are produced. FIGS. 12A to 12C show pictures of moments in that ink droplets are actually ejected, wherein FIG. 12A is when the ink droplets are deflected leftward; FIG. 12B is when is ejected without deflection; FIG. 12C is when is deflected rightward. As shown in FIGS. 12A to 12C, it is understood that the ink droplet is in an extremely slender shape in actual ejection. In addition, the ink droplets are practically ejected downward; however, in FIGS. 12A to 12C, they are ejected upward. As shown in FIGS. 12A to 12C, it was observe that the nozzle sheet 17 was slightly deformed at the moment of ejection.

Figure 13:
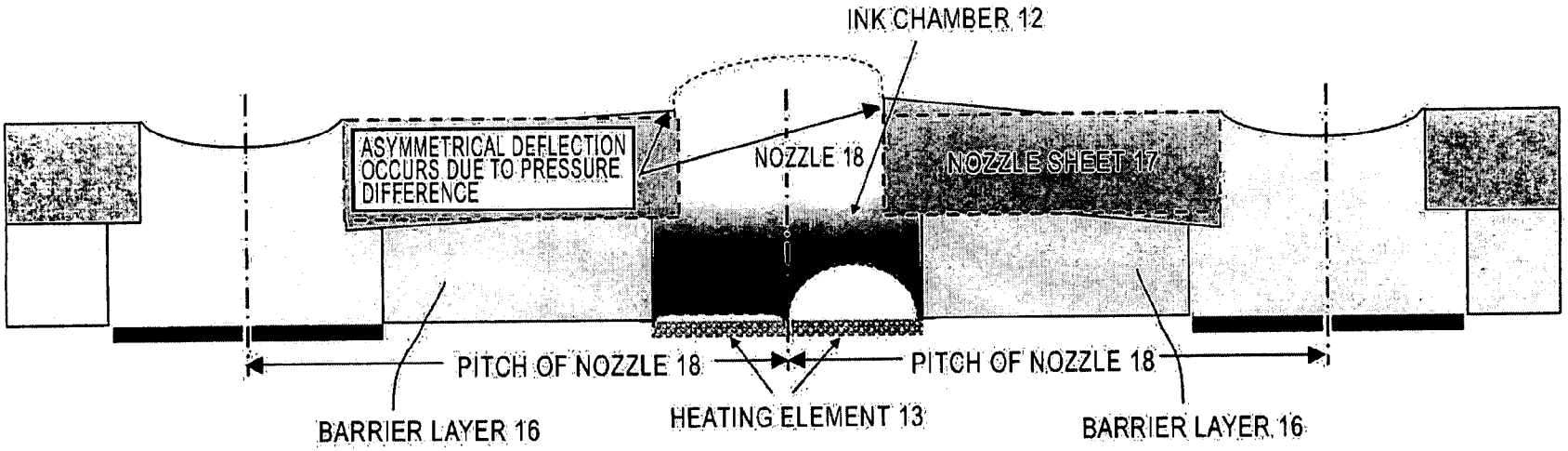
FIG. 13 is a drawing illustrating the situation where energy is applied to the heating elements of the central liquid ejection part and a bubble on the right heating element is rapidly growing.
Figure 14:
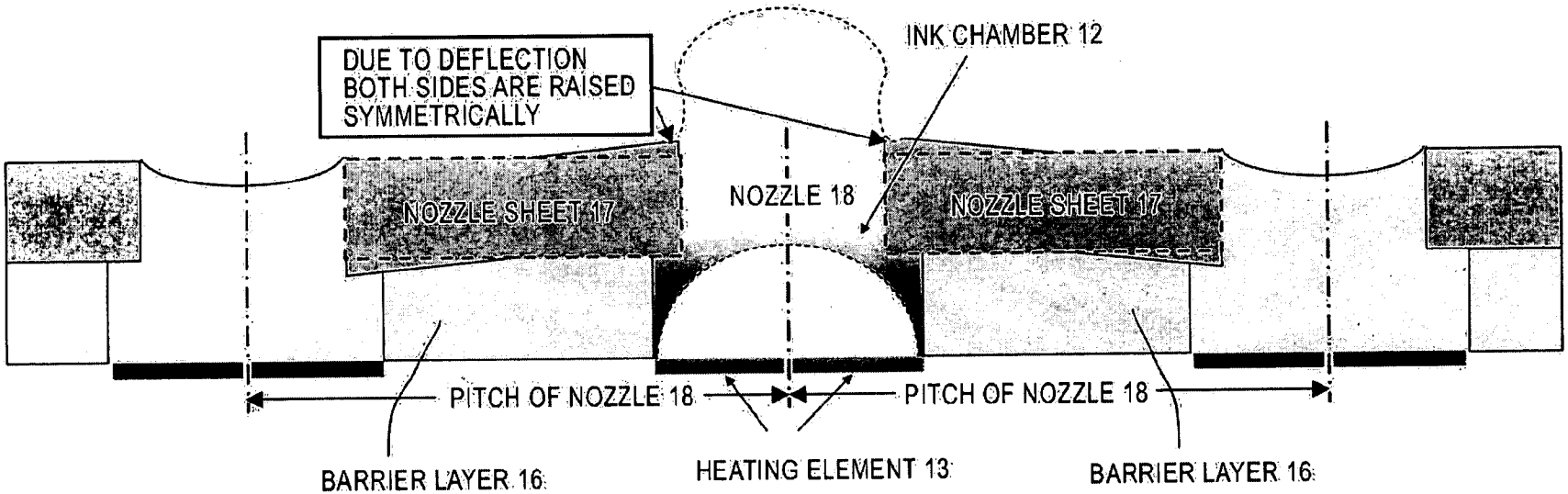
FIG. 14 is a drawing illustrating the situation where bubbles are growing on the entire heating elements.
Figure 15:
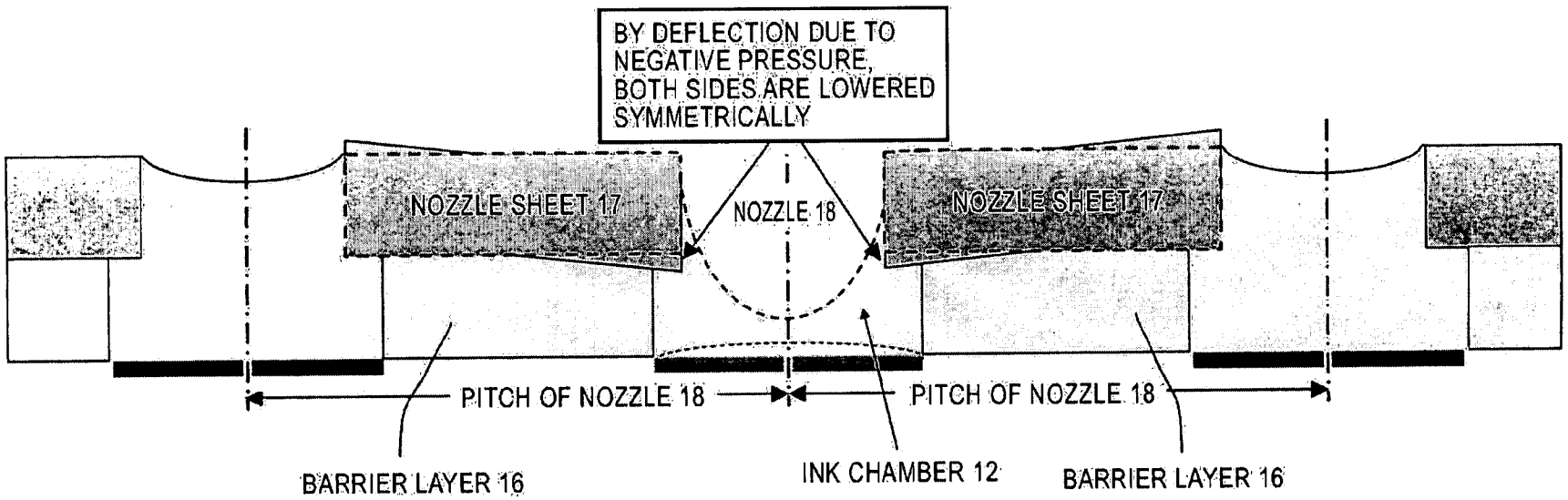
FIG. 15 is a drawing illustrating the progress of the bubble from shrinkage to extinction.

FIGS. 13 to 15 are sectional views (assumption drawings) for illustrating deformations of the nozzle sheet 17 and the barrier layer 16 produced by changes in pressure due to the ejection. In these drawings, for simplifying the deformations, the deformations are exaggerated. In the drawings, portions surrounded by dotted lines show positions of the nozzle sheet 17 without the deformation.

FIG. 13 is a drawing illustrating the situation where energy is applied to the heating elements 13 of the central liquid ejection part and a bubble on the right heating element 13 is rapidly growing. Within the ink chamber 12 at the right, sharp pressure fluctuation are produced, so that the nozzle sheet 17 and the barrier layer 16 are shown to have deformations with different amounts for the left and the right.

In this state, since the ink chamber 12 is inflated, ejection characteristics of the ejection part itself are affected by reduction in pressure lower than original one and slight inclination of the ejection face of the nozzle 18; however, in this state, ink droplets are not ejected from liquid ejection parts on both sides so that the adjacent liquid ejection parts are not affected.

With regard to an effect of the deformation, it has been confirmed that this effect of the deformation appears remarkably when the thickness of the nozzle sheet 17 is less than 10 μm in the present embodiment using electro-cast nickel as the nozzle sheet 17. This is understood as sharp changes in deformation with changes in thickness of the nozzle sheet 17 like a beam-strength problem.

FIG. 14 is a drawing illustrating the situation where bubbles are growing on the entire heating elements 13.

In this case, it is assumed that the nozzle sheets 17 on both sides be deformed at the same level. Since the volume of the entire ink chamber 12 is increased, the ejection pressure is assumed to be slightly decreased; however, because the ejection face of the nozzle 18 is deformed symmetrically with respect to the axis of the nozzle 18 unlike the case shown in FIG. 13, an effect on the ejection direction of ink droplets seems small.

In any of ejections with deflection and without deflection, when the number of the heating elements 13 is two, ink droplets may be pushed by one bubble in the final stage of the ejection; however, the moving direction parallel to the ejection face of the nozzle 18 is assumed to be determined by the initial state of the bubble generation also from the above description, the effect of the deformation of the nozzle sheet 17 may differ for the both heating elements 13.

FIG. 15 is a drawing illustrating the progress of the bubble from shrinkage to extinction. In this case, within the ink chamber 12, large negative pressure is assumed to produce rapidly. Since the ink droplets are already separated from the nozzle 18 so as to have a flying stage in this state, although the deflection of the nozzle sheet 17 is large, the effect on the ejecting angle may be removed.

As described above, the deformation of the nozzle sheet 17 affects the ejection of ink droplets.

In other words, the thickness of the nozzle sheet 17 is one of parameters affecting the deflected ejection. Hence, it is preferable to determine the thickness of the nozzle sheet 17 in view of this situation.

Then, the specific shape of the liquid ejection part will be described.

Figure 16:
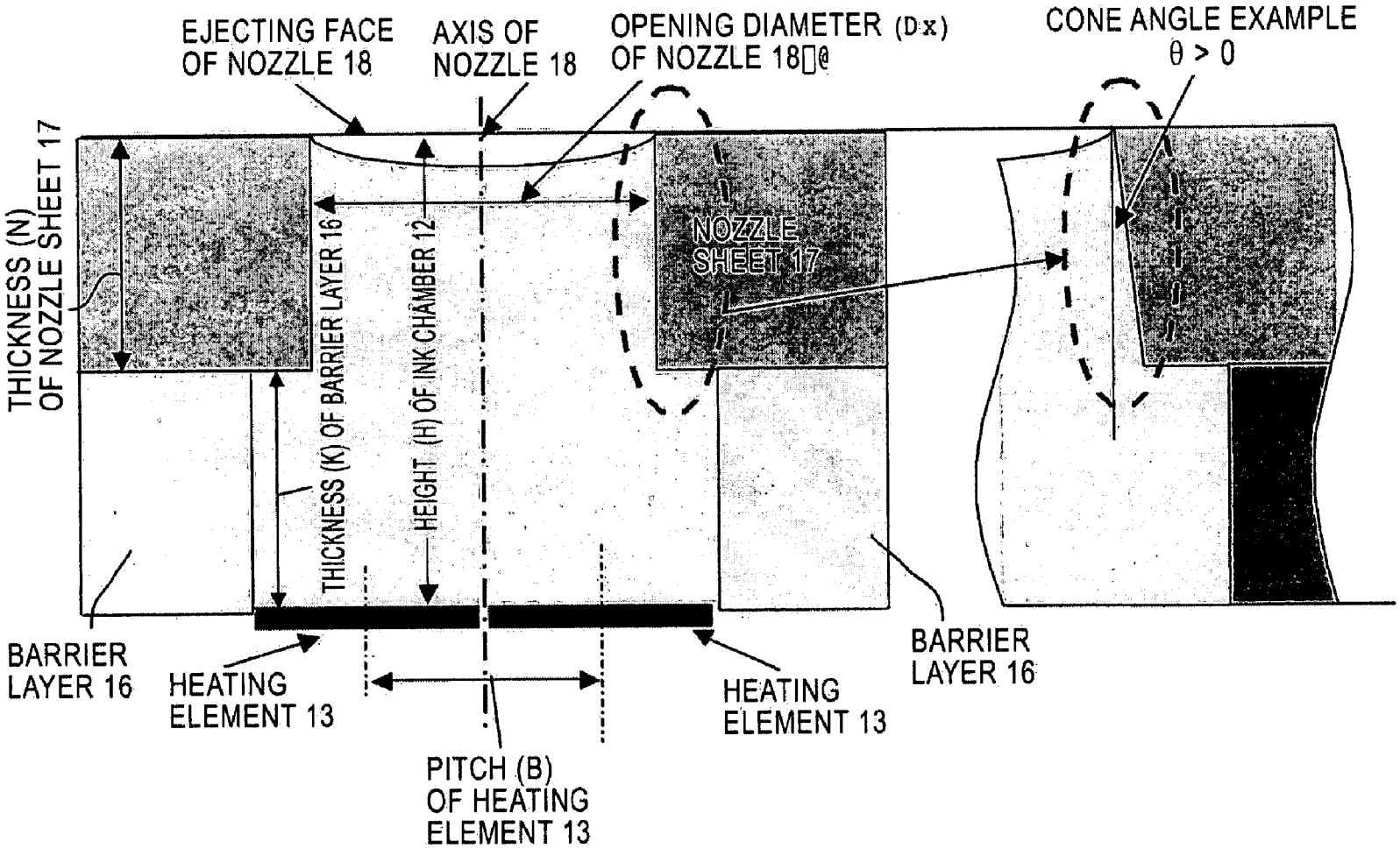
FIG. 16 is a sectional view for illustrating shapes of the nozzle sheet, the barrier layer, and the diameter of the nozzle.

FIG. 16 is a sectional view for illustrating shapes of the nozzle sheet 17, the barrier layer 16, and the opening diameter of the nozzle 18. Referring to FIG. 16, the relationship is shown as N+K=H, where N is the thickness (height) of the nozzle sheet 17; K is the thickness (height) of the barrier layer 16; and H is the height (height from the surface the heating element 13 to the ejection face of the nozzle 18) of the ink chamber 12.

Also, the opening diameter of the nozzle 18 is designated by Dx. The opening diameter Dx of the nozzle 18 is defined to be an opening diameter on the ejection face (surface) measured in the arranging direction of the two heating elements 13 (identical to the distance B between centers which will be described later). The reason of such definition is that as will be described later, among the opening diameters of the nozzle 18, the diameter may differ for the opening diameter Dx in the arranging direction of the two heating elements 13 and the opening diameter Dy in a direction perpendicular to the arranging direction of the two heating elements 13. That is, the shape of the opening of the nozzle 18 is not limited to a circle, and an ellipse and an oblong may exist.

In addition, the "oblong" means a so-called oval shape different from the ellipse in this specification having a straight portion in at least part thereof.

Furthermore, as the distance B between the centers of the two heating elements 13, a cone angle θ (an angle defined by the internal surface of the nozzle 18 and a line parallel to an axial line of the nozzle sheet 17) of the nozzle 18 in the nozzle sheet 17 is defined.

From the above investigation, an experimental equation (2) is obtained as follows:

$$Y=aK(X-0.5) \quad (2),$$

where X=Dx/H; the deflection when the vertical distance between the ink-droplet landing surface of a recording medium and the ejection surface of the ink droplets is 1.5 mm is Y; and a is an arbitrary constant (the basis of the experimental equation will be described later).

Figure 17:
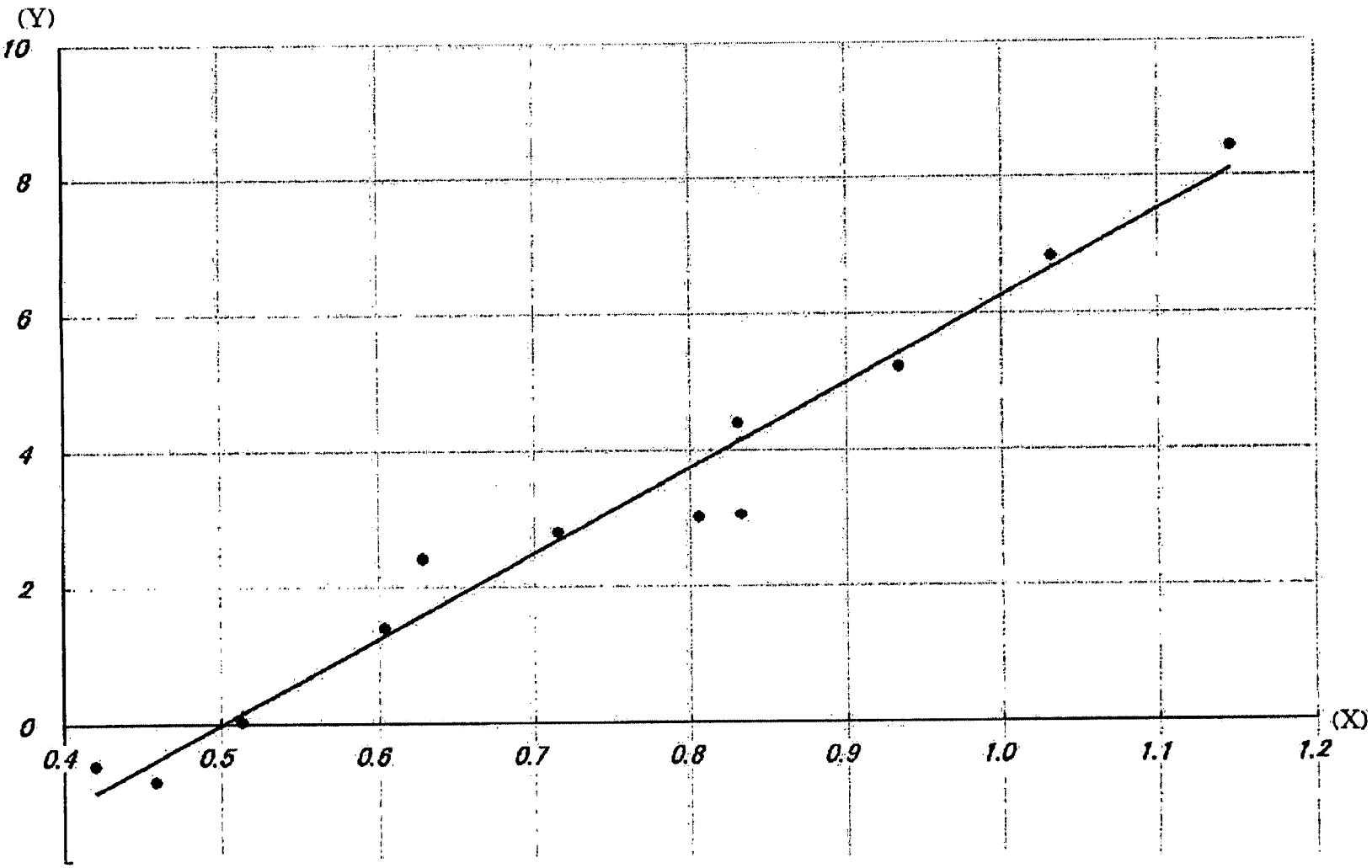
FIG. 17 is a graph showing the correlation between experimental data and the equation (2), wherein the experimental data are normalized as a=12.5 and K=1.

FIG. 17 is a graph showing the correlation between experimental data and the equation (2), wherein the experimental data are normalized as a=12.5 and K=1.

Referring to FIG. 17, Y=5 when X(=Dx/H)=0.9, for example, so that on the same condition (when the vertical distance between the ink-droplet landing surface of a recording medium and the ejection surface of the ink droplets is 1.5 mm) and if the thickness K of the barrier layer 16 is 10 μm, the deflection Y is:

$$5\times10=50\ \mu m.$$

Also, from the experimental data in FIG. 17, it has been understood that the deflection H is zero when X(=Dx/H)=0.5.

On the basis of the above equation 2, the optimization of deflected ejection of ink droplets i.e., the conditions enabling the deflection Y to be increased, will be described.

Figure 18:
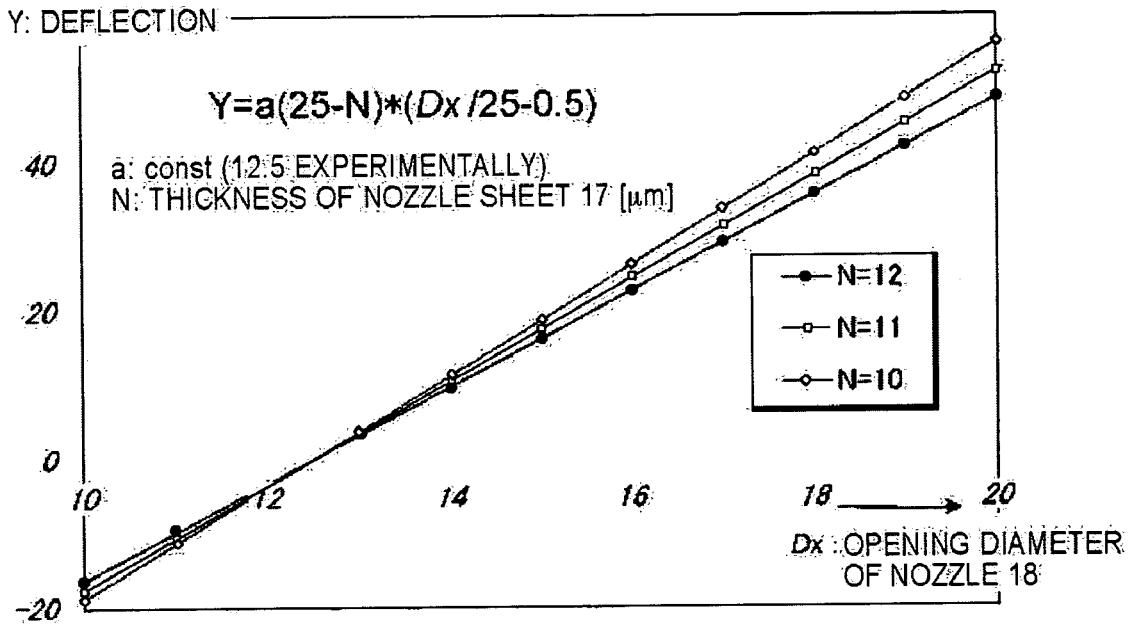
FIG. 18 is a graph showing changes in the deflection when the opening diameter of the nozzle and the thickness of the nozzle sheet are changed, and the height is constant.

FIG. 18 shows changes in the deflection Y when the opening diameter Dx of the nozzle 18 and the thickness N of the nozzle sheet 17 are changed, and the height H(=N+K)=25 μm as constant. In FIG. 18, a=12.5 in the equation 2. FIG. 18 expresses FIGS. 7A to 7F with specific numeric numbers.

In FIG. 18, in the same way as in FIG. 17, a singular point exists in which when Dx=12.5 μm, the deflection Y is zero (deflection sensitiveness is zero). From 18, it is understood that with increasing opening diameter Dx, the deflection Y also increases.

Figure 19:
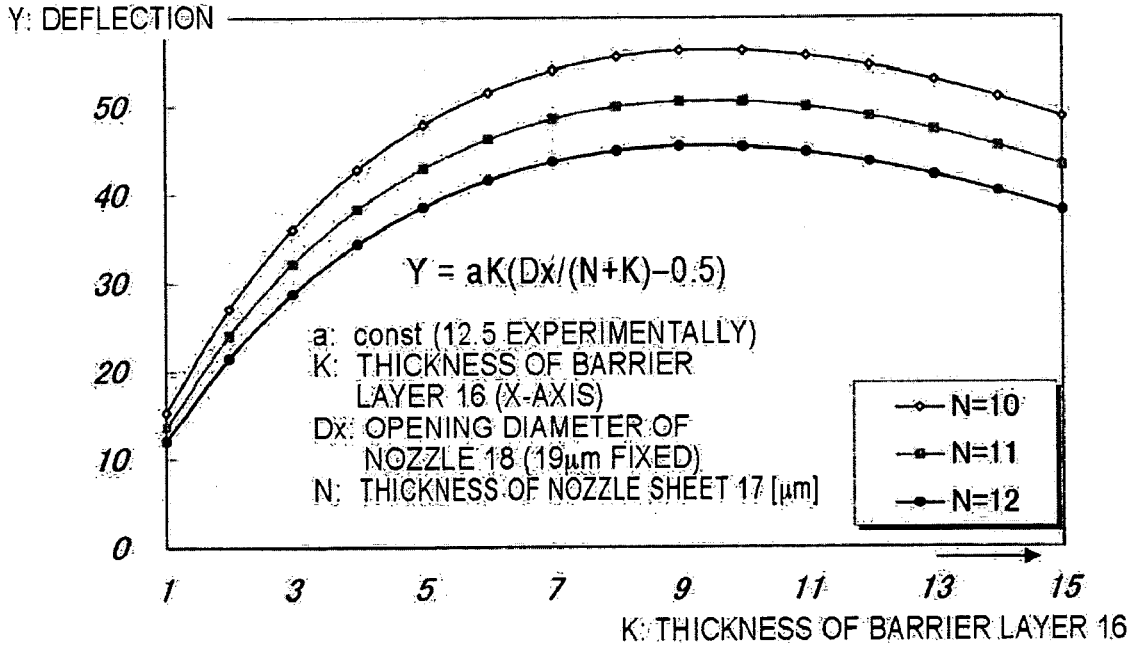
FIG. 19 is a graph showing changes in the deflection when the thickness of the nozzle sheet and the thickness of the barrier layer are changed, and the opening diameter of the nozzle is constant.

FIG. 19 shows changes in the deflection Y when the thickness N of the nozzle sheet 17 and the thickness K of the barrier layer 16 are changed, and the opening diameter Dx of the nozzle 18=19 μm as constant.

The fact understood from characteristics in FIG. 19 is that when the opening diameter Dx is constant, the value K exists which maximizes the deflection Y relative to the thickness N of the nozzle sheet 17.

In order to maximize the deflection Y, a condition may be found that the value is zero, which is obtained by partially differentiating the deflection Y with respect to a key variable.

Accordingly, if the equation 3 is placed as:

$$\frac{\partial Y}{\partial K} = a\left(\frac{Dx}{(N+K)} - 0.5\right) - \frac{aKDx}{(N+K)2} = 0, \quad (3)$$

then, if this is rearranged with K, the equation 4 is obtained as:

$$K=-N\pm\sqrt{2NDx} \quad (4).$$

Since K is positive, if the positive radical is taken, the equation (4) is as:

$$K=-N+\sqrt{2NDx} \quad (5).$$

This equation (5) is a condition for giving an inflection point in FIG. 19.

When the equation (5) is substituted into the equation (2), the value of the deflection Y is denoted as $Y_{max}$ which is:

$$Y_{\max} = \frac{a}{2}\left(\sqrt{2Dx} - \sqrt{N}\right)^2. \quad (6)$$

Figure 20:
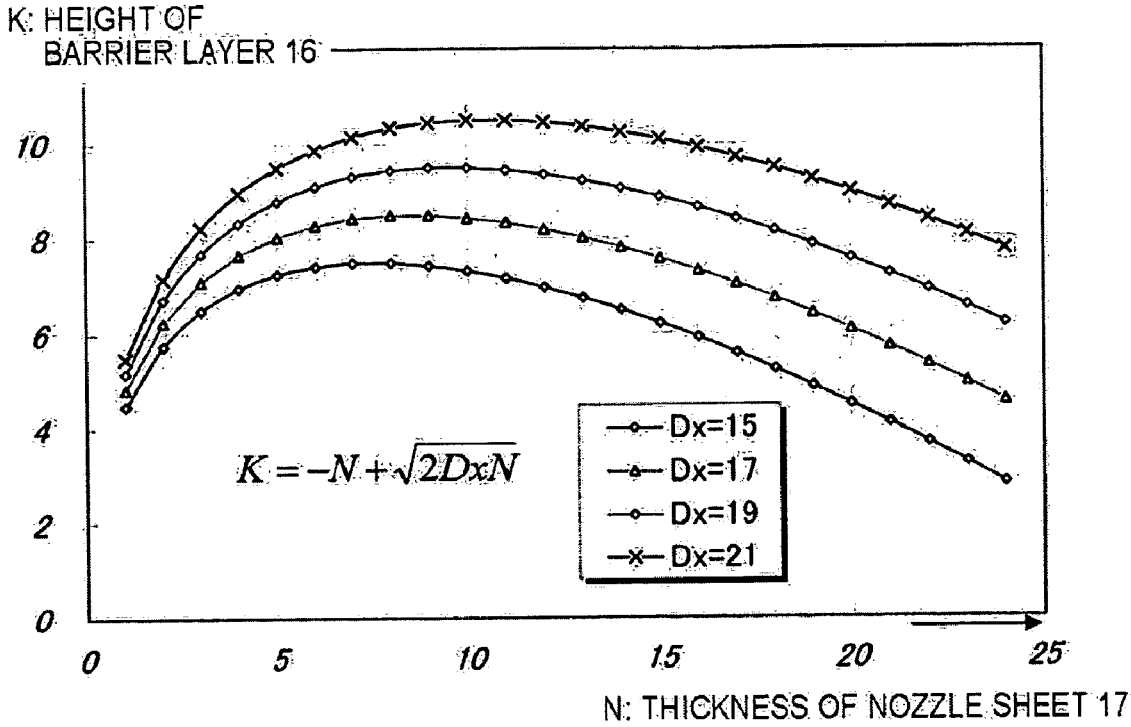
FIG. 20 is a drawing showing the equation (5)
Figure 21:
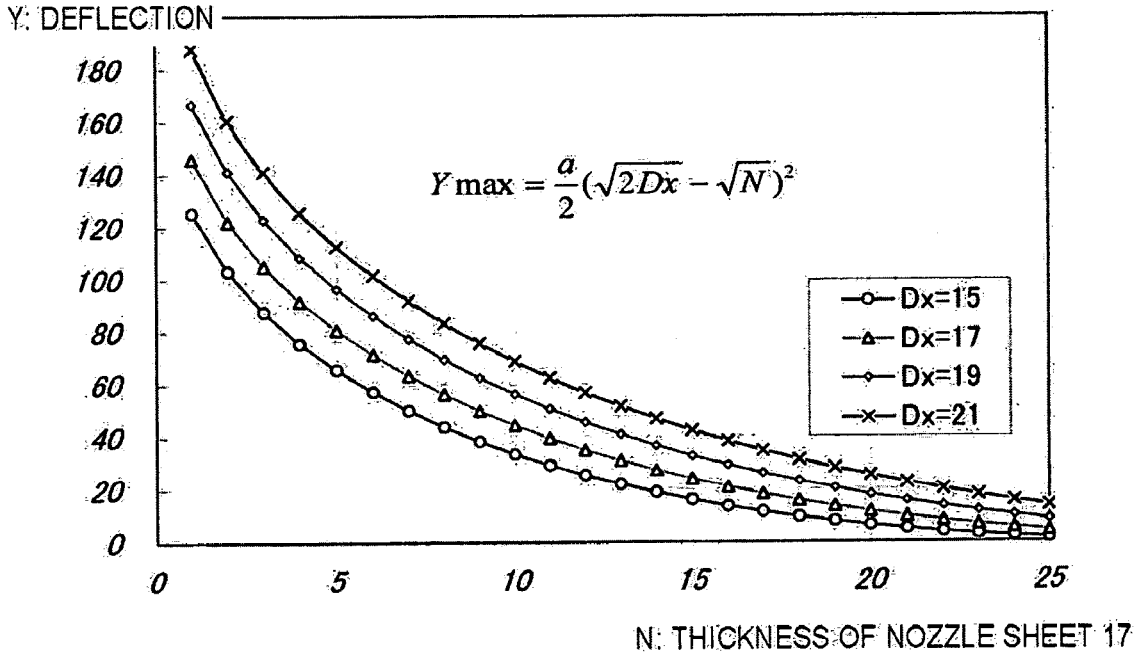
FIG. 21 the equation (6)

FIG. 20 is a drawing showing the equation (5); FIG. 21 the equation (6). FIGS. 20 and 21 connect points of $Y_{max}$ obtained from points of the thickness N of the nozzle sheet 17.

Figure 22:
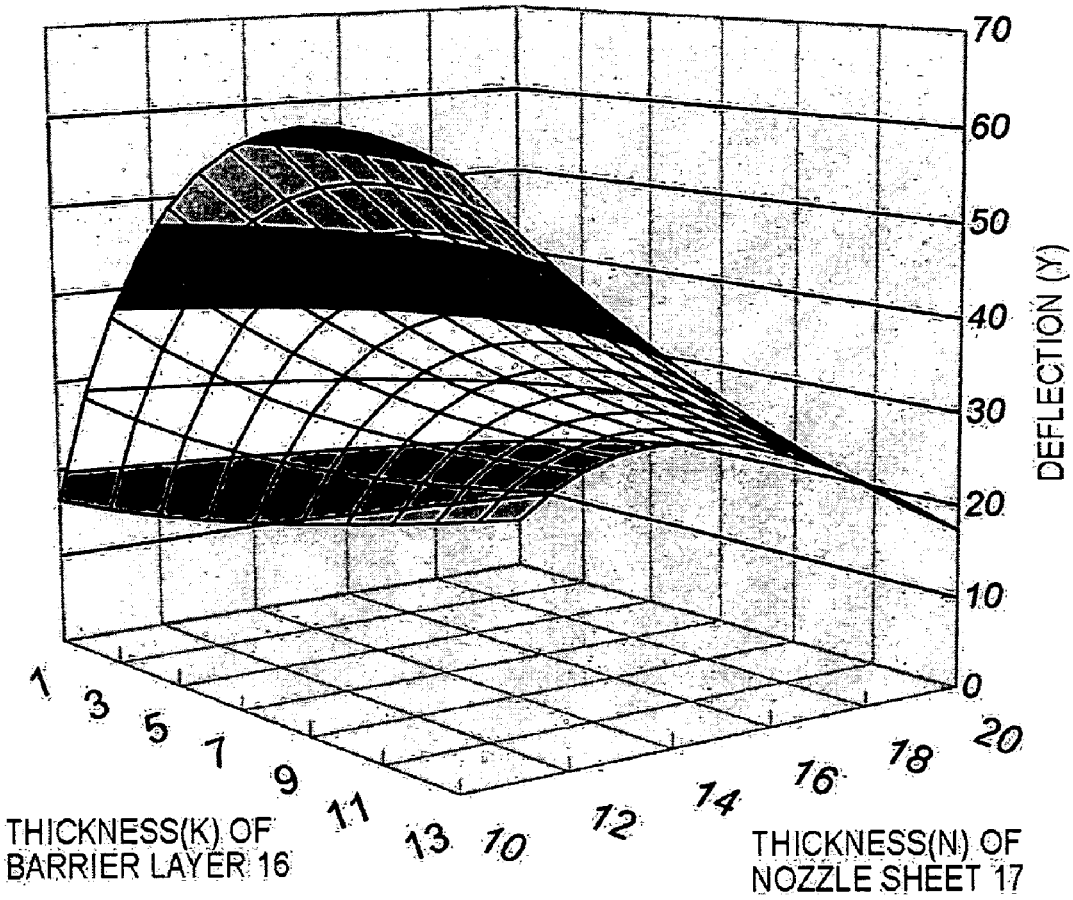
FIG. 22 is a drawing showing three principal parameters with a three-dimensional body.

In FIGS. 18 to 21 described above, three principal parameters determining deflection characteristics, which are the opening diameter Dx (1), the thickness K of the barrier layer 16 (2), and the thickness N of the nozzle sheet 17 (3), are sequentially shown with two-dimensional graphs. Whereas, in FIG. 22, the three principal parameters are shown with a three-dimensional body. In FIG. 22, the opening diameter Dx is set to be 20 μm, so that the range of the thickness N of the nozzle sheet 17 is shown narrowly than that of FIG. 21.

From the consideration described above, it is preferable that the specific shapes of the liquid ejection part be designed as follows:

First, it is important that as the two heating elements 13 in one ink chamber 12, two bubble-generating regions be juxtaposed with the same surface shape and the same heating characteristics.

Also, it is preferable that the two heating elements 13 (two bubble-generating regions) arranged within the ink chamber 12 be arranged symmetrically with respect to a plane passing through the axis of the nozzle 18 and being normal to the ejection face of the nozzle 18 while the ink chamber 12 and the nozzle 18 be shaped symmetrically with respect to the plane.

By such a structure, deflection characteristics can be symmetrical about the point at which the deflection Y=0. Furthermore, in a case where the energy amount to be applied to the two heating elements 13 is reversed, in order to make the deflection Y mirror symmetric with respect to the former case (not reversed), it is preferable the shapes of the nozzle 18, the ink chamber 12, and the heating element 13 and the arrangement of the two heating elements 13 be substantially plane-symmetrical with respect to the axis of the nozzle 18.

It is also preferable that the relationship between the distance B between centers, which connect the respective centers of the two heating elements 13 arranged within the ink chamber 12 in the arranging direction of the two heating elements 13, and the opening diameter Dx of the ejection face of the nozzle 18 in the arranging direction of the two heating elements 13 be expressed by:

$$Dx>B \quad (7).$$

It is also preferable that the relationship between the thickness N of the nozzle sheet 17 and the opening diameter Dx of the ejection face of the nozzle 18 be expressed by:

$$N<2\times B \quad (8).$$

The basis thereof is that as shown in FIG. 18 for the relationship in equation (7); in FIG. 21 for the relationship in equation (8), the sufficiently meaningful deflection Y can be secured in the region satisfying the two relationships of equations (7) and (8).

The equations (7) and (8) use the distance B between centers as a reference. One of the reasons thereof, although the arrangement pitch of the nozzles 18 may be used as a reference if the deflection direction is the arranging direction of the heating elements 13, is that the deflection may be performed, differently from the arranging direction of the nozzles 18, in a direction perpendicular to this direction depending on the object. Another reason, as will be described later, is that it is confirmed that if the opening diameter Dx of the nozzle 18 is a diameter in the arranging direction of the two heating elements 13, the opening diameter Dx is applied to the equation (2) mostly well.

Moreover, it is preferable that the relationship between the opening diameter Dx of the ejection face of the nozzle 18 in the arranging direction of the two heating elements 13 within the ink chamber 12 and the opening diameter (referred to as Dy below) of the ejection face of the nozzle 18 in a direction perpendicular to the arranging direction of the two heating elements 13 within the ink chamber 12 be expressed as:

$$Dx>Dy \quad (9).$$

Figure 23:
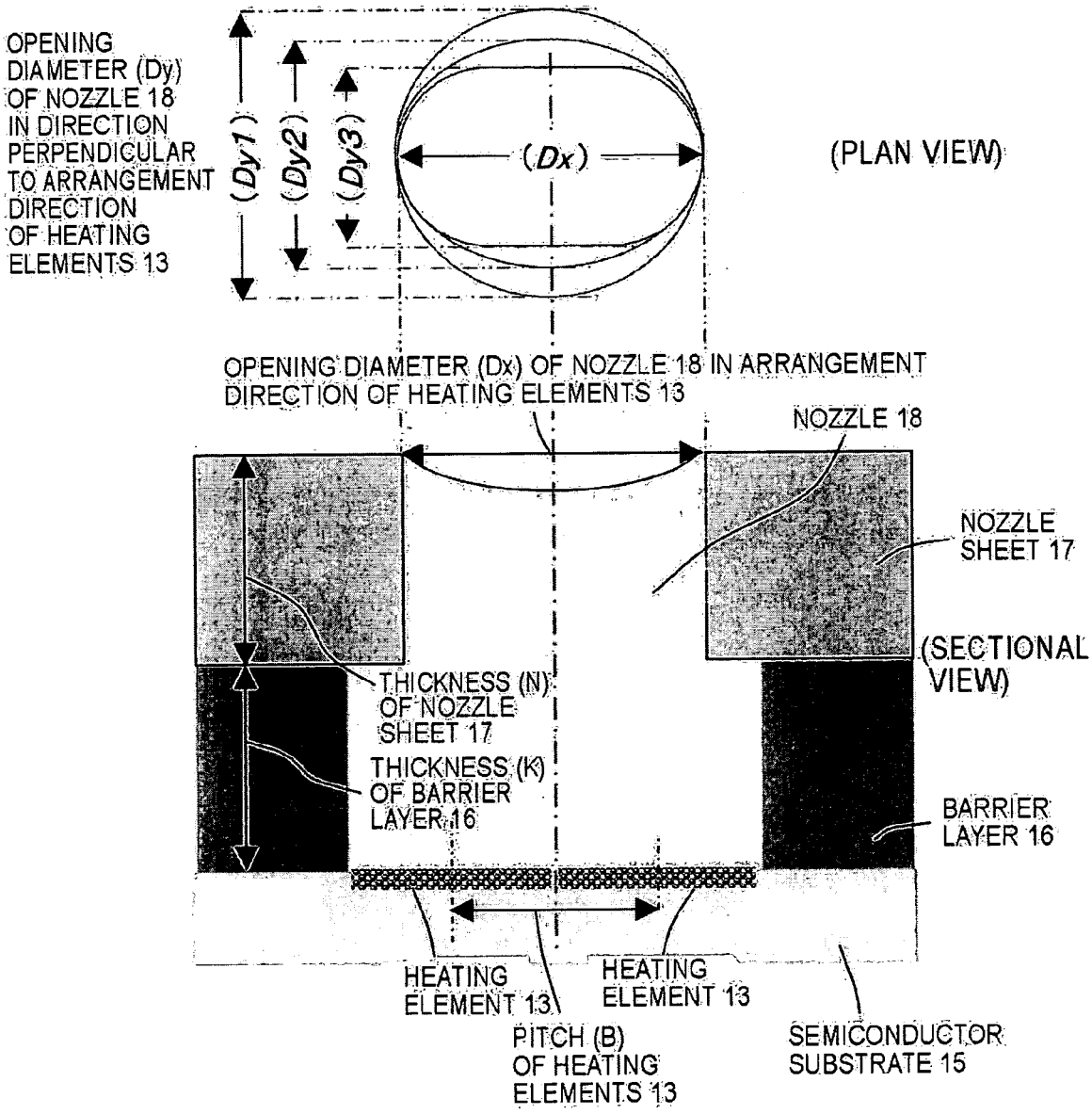
FIG. 23 includes a plan view and a sectional view showing the opening diameter of the nozzle.

FIG. 23 includes a plan view and a sectional view showing the relationship between the opening diameter Dx of the nozzle and the opening diameter Dy (Dy1, Dy2, Dy3).

The reason why the relationship is defined as equation (9) is that although the opening shape of the nozzle 18 is generally circular, it is not necessarily circular, and the deflection Y is secured to have a substantially constant amount as long as the opening diameter Dx in the arranging direction of the nozzles 18 is constant.

That is, as it is understood that if the value of Dx is constant, even if the value of Dy is slightly changed, the deflection characteristics are scarcely affected thereby (see Examples below), if the value of Dx is large and Dy is suppressed small, the demand from ink-jet printers that only the deflection Y can be secured while the amount of ink droplets to be ejected is maintained comparatively small can be achieved.

The opening shape of the nozzle 18 is not limited to a circle and an ellipse, and it may also be an oblong and a polygon, such as a square and a rectangle, as a principal shape, and corners may be rounded on demand.

FIG. 23 shows an example of three shapes (a circle (Dy1), an ellipse (Dy2), and an oblong (Dy3)) with the same Dx value.

Furthermore, it is preferable that the thickness K of the barrier layer 16 (the distance from the surface of the heating element 13 to the surface of the nozzle sheet 17 opposing the heating element 13) be a value K within −2.5% ($0.75 \leqq K/K_{opt} \leqq 1$) of the maximum deflection Y achieved by:

$$K_{opt}=\sqrt{2NDx}-N \quad (10).$$

In other words, it is preferable that the value K be established within the range of:

$$0.75\times(\sqrt{2NDx}-N) \leqq K \leqq \sqrt{2NDx}-N \quad (11).$$

As described above, the three principal parameters determining the maximum deflection Y are the opening diameter Dx of the nozzle 18, the thickness K of the barrier layer 16, and the thickness N of the nozzle sheet 17. The maximum deflection Y means a deflection Y obtained when deflected ejection is performed under the maximum electrical conditions that while energy is applied to the two heating elements 13 simultaneously, energy with different energy surface-densities is applied to the two heating elements 13 so that the bubble-generation time differs for film-boiling on the two heating elements 13.

As is understood from FIGS. 18 to 22 described above, with increasing opening diameter Dx, and with decreasing thickness N of the nozzle sheet 17, the deflection Y increases. That is, the relationship is a monotonic increasing function (to the opening diameter Dx) or a monotonic decreasing function (to the thickness N of the nozzle sheet 17). However, to the thickness K of the barrier layer 16, the relationship is neither a monotonic increasing function nor a monotonic decreasing function, so that for given Dx and N, the specific value K ($K_{opt}$) maximizing the deflection Y exists.

Although $K=K_{opt}$ as an ideal case, as long as the deflection demanded from ink-jet printers is not so large, it is not necessarily that $K=K_{opt}$.

Then, according to the present invention, on the basis of experimental results, the value K is determined to be within the equation (11) (up to −25%).

The three principal parameters Dx, N, and K determining the deflection Y are summarized with regard to the selection reference of numeric values as follows:

(1) The Opening Diameter Dx

In order to increase the deflection Y as large as possible, the larger opening diameter Dx is advantageous. However, if it is simply increased, the dot diameter formed on a recording medium is increased proportionately, resulting in deterioration in image quality (increase in rough sensibility and irregularity in dot arrangement). Hence, it is preferable that the opening diameter Dy (opening diameter in a direction perpendicular to Dx) be small so that the opening area of the nozzle 18 is not increased.

(2) The Thickness N of the Nozzle Sheet 17

If the strength (rigidity) withstanding changes in pressure upon ejection of ink droplets is maintained, with decreasing thickness N, the deflection Y can be increased. However, the thickness N is substantially uniquely determined by physical characteristics of the material and the structure of the liquid ejection part.

On the other hand, with the liquid ejection part without deflection, by increasing the thickness N, ink droplets can be ejected more straight.

(3) The Thickness K of the Barrier Layer 16

As described above, the optimum value exists in the thickness K of the barrier layer 16. As the value K, if the similar value is taken from equation (5) or the value of $K_{opt}$, the deflection Y can be maximized.

(4) The Singular Point of the Deflection Y

As described above, the singular point exists in the deflection Y. At this point, ink droplets are scarcely ejected. As a using method of the singular point, for Dx, the value of the deflection Y is increased, and for Dy, by setting Dy in the vicinity of the singular point, the direction of Dy (direction perpendicular to the arranging direction of the heating elements 13) can also be established so that ink droplets are scarcely deflected.

Furthermore, with regard to the shape of the nozzle 18, it is preferable that the relationship between the opening diameter Dx of the nozzle 18 (the arranging direction of the heating elements 13) and the opening diameter Dx' of the surface facing the heating element of the nozzle be:

$$Dx<Dx'.$$

For example, when the internal surface of the nozzle 18 is tapered, and in FIG. 16, the cone angle θ is negative (i.e. Dx<Dx'), the disturbance received by the surface of the nozzle 18 facing the heating element 13 is increased so that the deflection Y and deflection characteristics are affected. Hence, it is preferable that Dx<Dx'.

With the internal (spatial) shape of the nozzle 18, in addition to a shape in that when viewing the section of the internal shape of the nozzle 18, the side wall is a straight line, such as a truncated cone (shape formed when a trapezoid is rotated about its vertical axis), as shown in FIG. 2, it may be curved line.

For example, when the internal surface of the nozzle 18 is tapered, it may have a tapered surface in that the opening diameter Dx of the nozzle 18 increases toward the heating element 13.

Consequently, the preferred structure of the head 11 will be described.

First, a plurality of liquid ejection parts with the same shape are arranged in the arranging direction of the two heating elements 13 as shown in FIG. 1. Outside the nozzles 18 arranged on both ends, it is preferable that the nozzle sheets 17 be further extended while liquid ejection parts without ejection of ink droplets be provided. This liquid ejection part may be without the heating element 13; however, at least the nozzle 18 (the nozzle sheet 17) and the ink chamber 12 (the barrier layer 16) are provided.

As described above, during ejection of ink droplets, the nozzle sheet 17 is deformed.

The ejection characteristics differ for the ejection of ink droplets from the liquid ejection part having the liquid ejection parts on both sides and for the ejection of ink droplets from the liquid ejection part located at the end (without the liquid ejection part on one side). If this changes in ejection characteristics are negligible (scarcely affecting), it seems no harm. In order to have ejection characteristics with high accuracy, dummy liquid ejection parts (without ejection of ink droplets) may be provided on both sides of the head 11, so that there are always liquid ejection parts on both sides of the liquid ejection part. In such a manner, it is preferable that the nozzle sheets 17 on both sides of the liquid ejection part be elastically deformed so as to balance the deformation.

Also, it is preferable that a plurality of the entire nozzles 18 in the head 11 be arranged in one direction (linearly especially according to the embodiment), and it is also preferable that ejection faces of a plurality of the entire nozzles 18 be arranged to be flush with the same plane.

By the arrangement of the nozzles 18 in one direction, the landing pitch of ink droplets in the arranging direction of the nozzles 18 can be confirmed.

The arrangement of the nozzles 18 is not necessarily linear as long as it is in one direction. Japanese Patent Application No. 2003-383232, to the same assignee, has already proposed an unpublished earlier application technique. In this technique, a plurality of liquid ejection parts (nozzles) are arranged at a constant pitch P, and the centers of the nozzles of liquid ejection parts adjacent to each other among the plurality of liquid ejection parts are arranged in a direction perpendicular to the arranging direction of the plurality of liquid ejection parts at an interval of X (X is a real number more than zero). In other words, the liquid ejection parts (nozzles) are arranged in a staggered form.

By this technique, deformations of the nozzle 18 and its peripheral region due to changes in pressure with the ejection of ink droplets are reduced, so that the ejection amount and the ejection direction of ink droplets can be stabilized. Hence, since it is advantageous for deflected ejection to rather reduce the thickness of the nozzle sheet 17, even when the thickness of the nozzle sheet 17 is decreased with this technique, stable and high quality ejection of ink droplets can be performed by suppressing the deformation of the peripheral region of the nozzle 18 during ejection of ink droplets.

Also, by arranging ejection surfaces of the nozzles 18 so as to be flush with the same plane, the accuracy in landing position of ink droplets during deflected ejection can be more improved.

For example, if a plurality of the nozzles 18 are not flush with the same plane, the distance between the ejection face of the nozzle 18 and a recording medium differs for each nozzle 18.

In this case, when ink droplets are ejected with deflection, the landing position differs. Hence, when deflection ejection is performed in particular, it is preferable that a plurality of the ejection faces of the nozzles. 18 be flush with the same plane (the surface of the nozzle sheet 17 having the nozzles 18 formed thereon have a high flatness without a warp).

Then examples of the present invention will be described.

EXAMPLE 1

Figure 24:
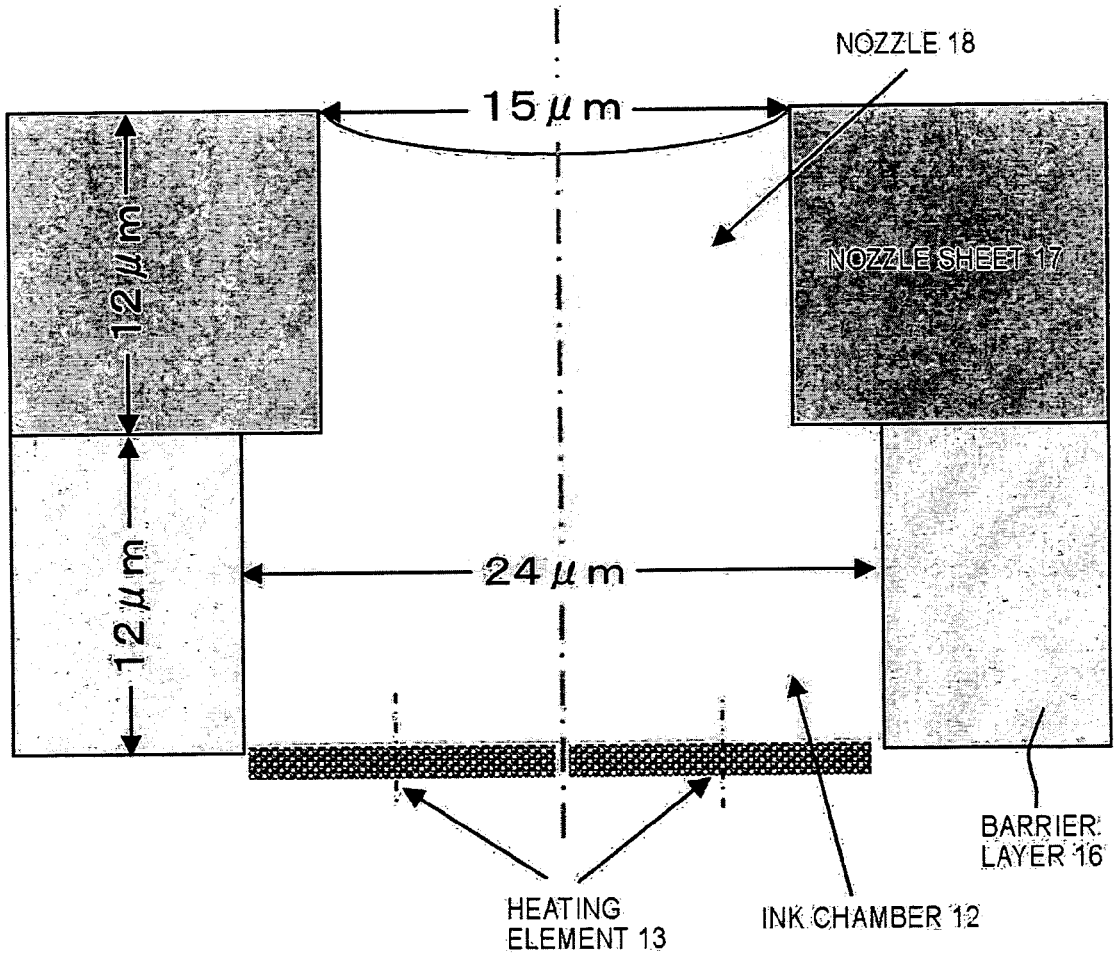
FIG. 24 is a sectional view showing specific shapes (sizes) of the liquid ejection part.
Figure 25:
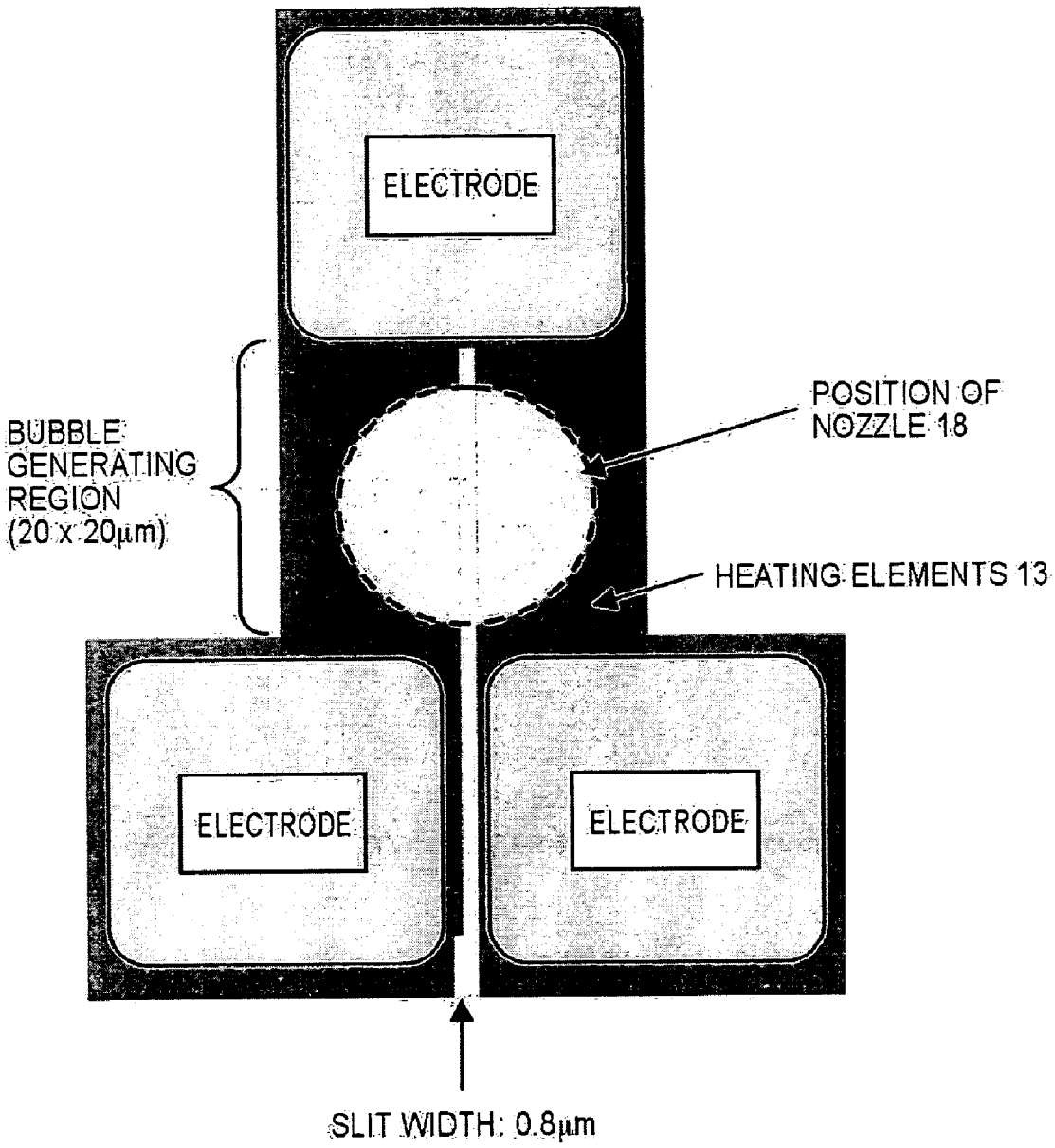
FIG. 25 is a plan view of the two heating elements in one liquid ejection part.

FIG. 24 is a sectional view showing specific shapes (sizes) of the liquid ejection part; FIG. 25 is a plan view of the two heating elements 13 in one liquid ejection part.

As shown in FIG. 24, the diameter D of the nozzle 18 was 15 μm. Since the opening shape of the nozzle 18 was circular in Example 1, diameter D (=Dx=Dy) was used.

Also, the thickness N of the nozzle sheet 17 was 12 μm, and the thickness K of the barrier layer 16 was 12 μm. Thus, K+N=24 μm. Furthermore, the length of the heating element 13 in the arranging direction was 24 μm.

Moreover, as shown in FIG. 25, the bubble-generating region (heating region) of the heating element 13 was a square of 20×20 μm, and the clearance (slit width) between the two bubble-generating regions was 0.8 μm.

In the above-description, the two heating elements 13 arranged within one liquid ejection part have been described as "divided into two pieces"; however, in practice, one heating element 13 (not physically separated), as shown in FIG. 25, was formed in a substantial inverted U-shape and electrodes were provided at both ends and in an inflection portion at the upper central part, three electrodes in total, so as to form the two juxtaposed bubble-generating regions (heating regions). In such a manner, "the two heating elements 13" are not necessary to be physically separated, and in design, the shape shown in FIG. 25 is rather easily manufactured.

Also, the two bubble-generating regions were established to have the same surface shape and the same heating characteristics. The heating element 13 was made of tantalum by sputtering, and the resistance of one bubble-generating region was about 75 Ω, and the two bubble-generating regions were connected in series so as to have a resistance of about 150 Ω.

Furthermore, in FIG. 25, the position of the nozzle 18 is shown by a broken line. The two bubble-generating regions were arranged symmetrically with regard to the axis of the nozzle 18.

Figure 26:
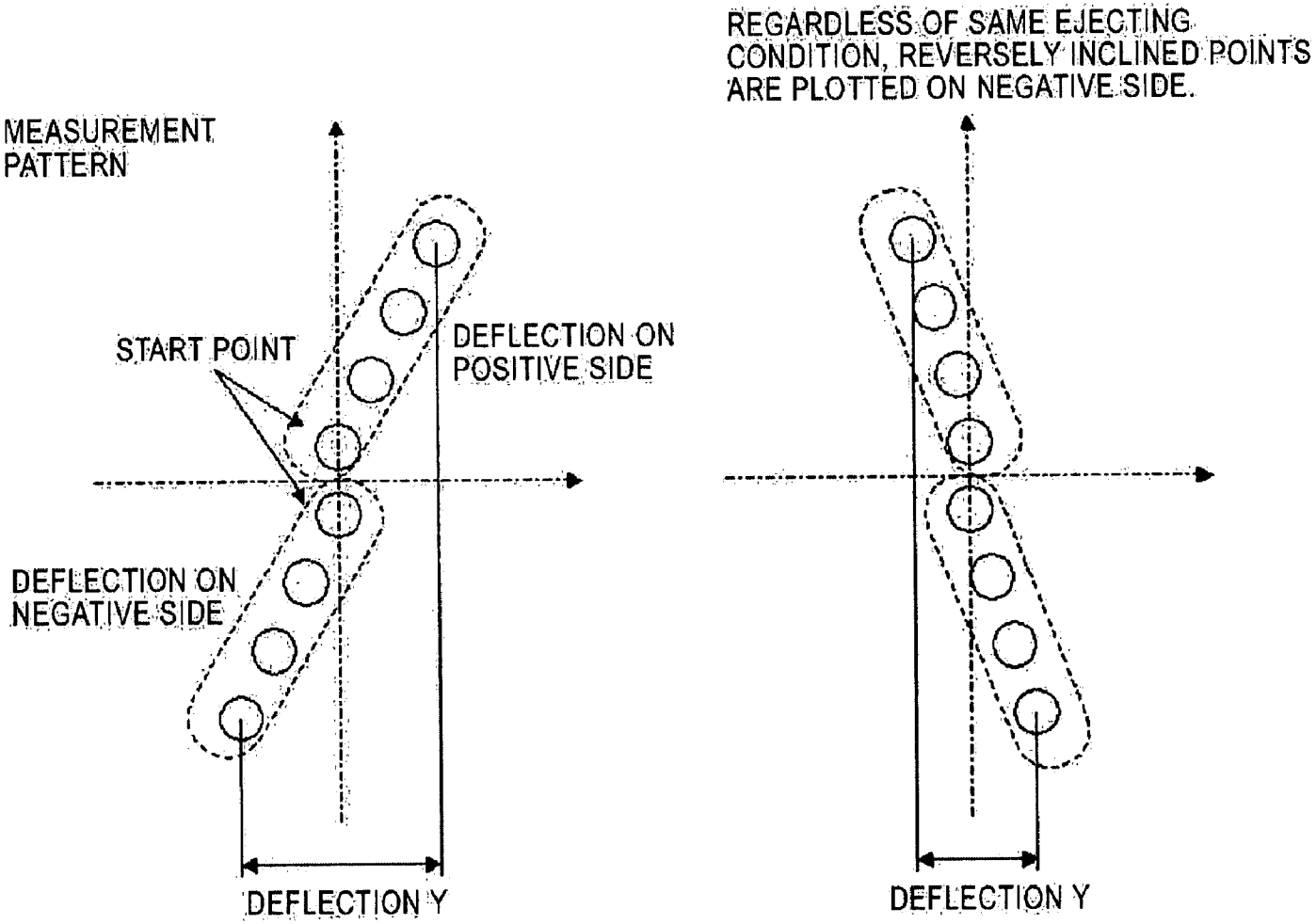
FIG. 26 includes drawings for illustrating the definition of the deflection.

FIG. 26 includes drawings for illustrating the definition of the deflection Y. Since in practice, the ejection angle of ink droplets is about 3 to 40 at most with regard to the axis of the nozzle 18, it is difficult to accurately measure it. Then, the landing position when ink droplets were deflected relative to the landing position when ink droplets were not deflected (in a direction agreeing the axis of the nozzle 18) was measured as the deflection Y in FIG. 26 (the distance between the ejection face of the nozzle 18 and a recording medium was about 1.5 mm).

EXAMPLE 2

Figure 27:
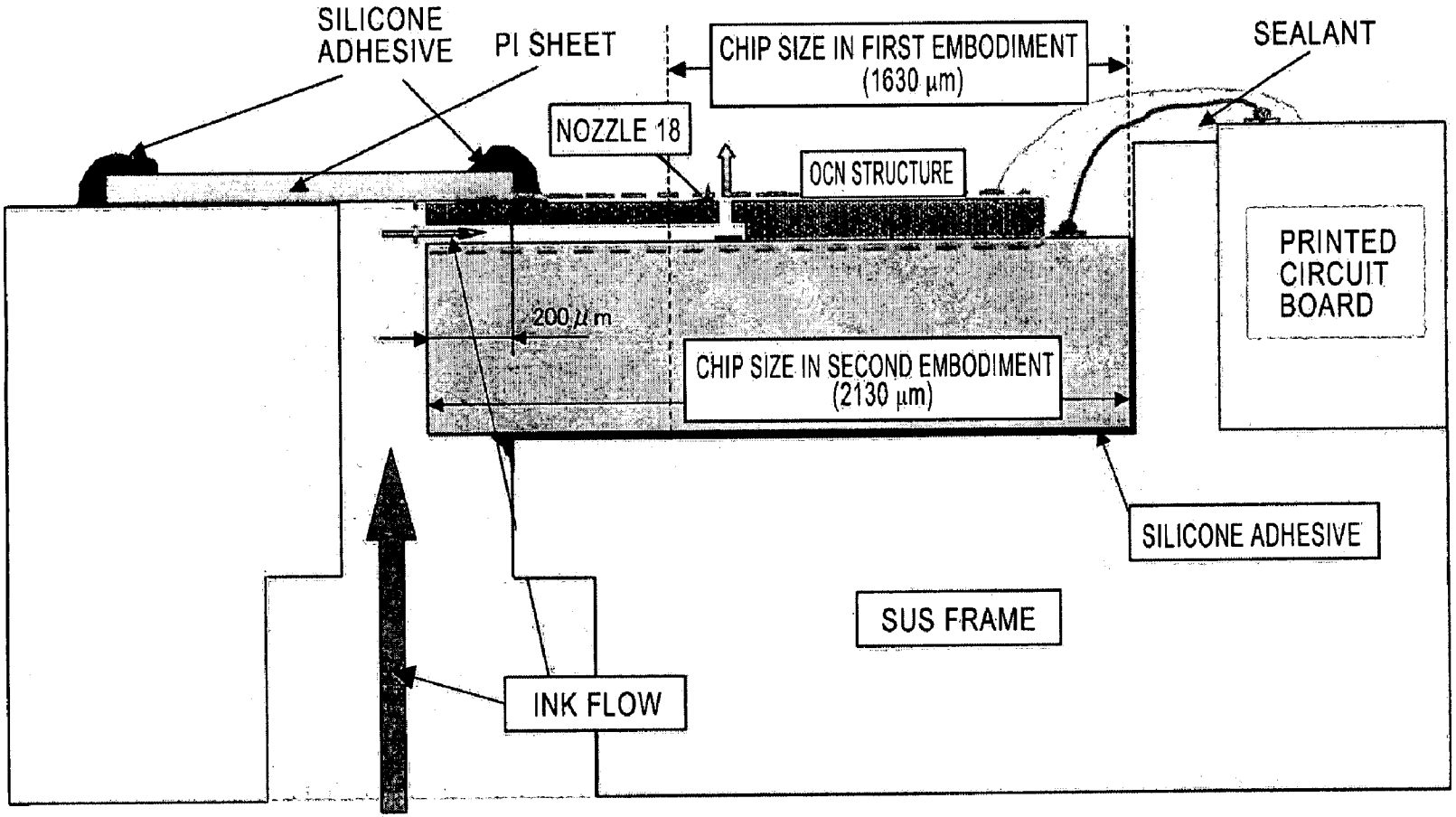
FIG. 27 is a sectional view showing specific structure of the head in Example 2.

FIG. 27 is a sectional view showing specific structure of the head in Example 2.

As shown in FIG. 27, in the experiment, a nozzle group with an OCN (on chip nozzle) structure forming the nozzles 18 was directly formed on a semiconductor chip using a photolithography technique so as to experimentally have nozzles with various parameters on the same chip.

The reason to use the OCN structure is that first, since the nozzle 18 can be made of transparent acrylic resin, phenomena produced in the nozzle 18 can be visually observed; secondly, since the various nozzles 18 can be accurately produced, reliability in numeral numbers obtained from the experiment can be improved by maintaining parameters other than the parameter required to change under the same condition as the nozzles under other conditions as strongly as possible.

EXAMPLE 3

In Example 1, the nozzle 18 with a circular opening shape was used. In Example 3, the opening shape of the nozzle 18 was an ellipse or an oblong other than a circle (Dx≠Dy), and the opening diameters Dx and Dy were changed.

In Example 3, the entire parameters other than the opening shape were the same.

FIG. 28 is a table showing twelve experimental results versus evaluation items. The three parameters being assumed affecting the deflection Y (the diameter D of the nozzle 18 (=Dx=Dy): the thickness K of the barrier layer 16: and the thickness N of the nozzle sheet 17) were appropriately selected herein so as to actually measure them. The measurement of the deflection Y was as shown in FIG. 26. The evaluation items 1 to 5 are provisional calculations for showing the correlation.

FIG. 29 is a table, in the same way as in FIG. 28, showing experimental results versus evaluation items regarding the nozzle 18 with opening shapes of a circle and an oblong. In FIG. 29, in order to check changes due to the opening shape of the nozzle 18, other parameters except the shape of the nozzle 18 are equalized in conditions.

Figure 30:
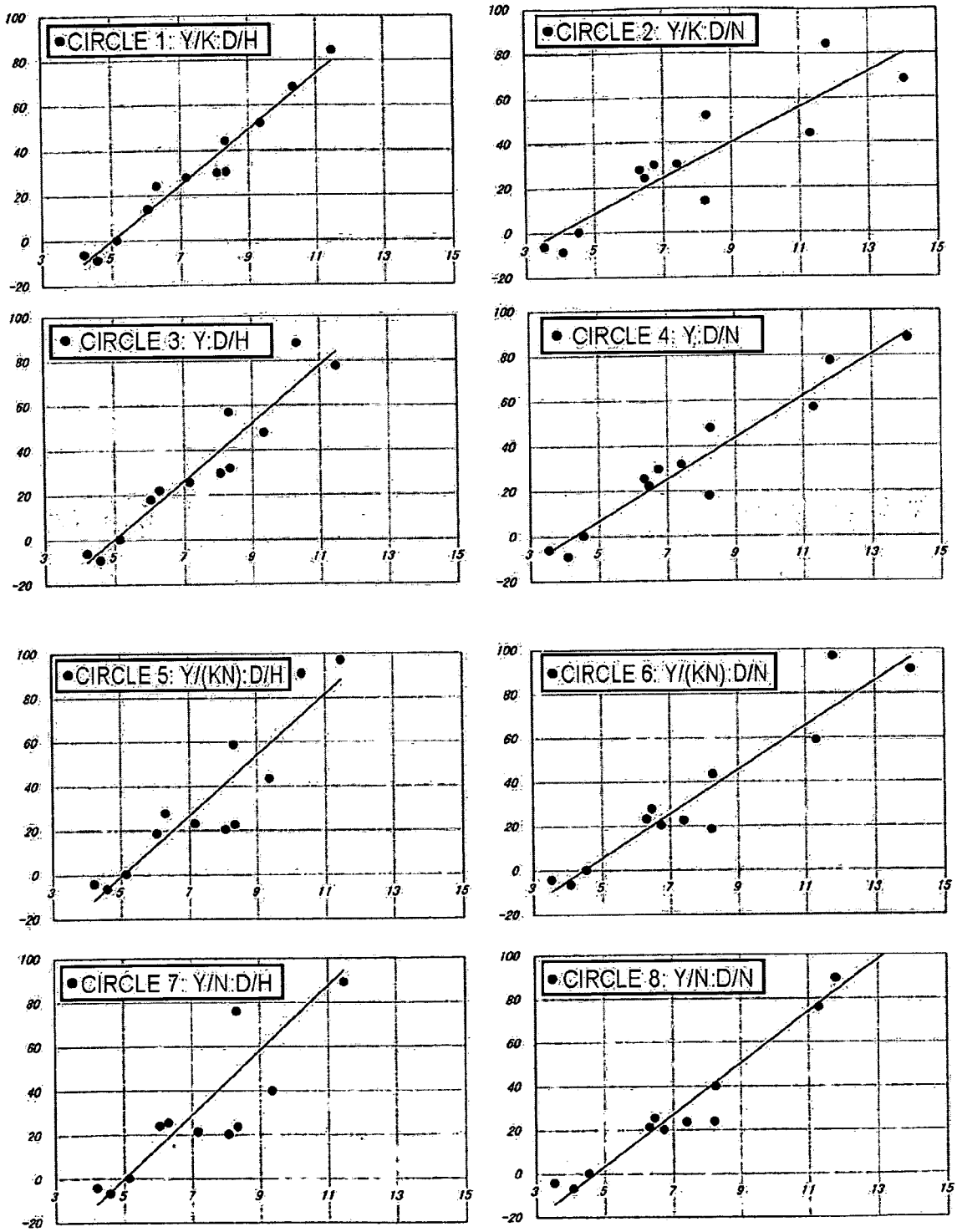
FIG. 30 includes graphs of the results from FIG. 28.

Furthermore, FIG. 30 includes graphs of the results from FIG. 28.

In the eight graphs shown in FIG. 30, any of dots is entirely based on the experimental results, and only the evaluation method is simply changed. In FIG. 30, four graphs (1, 3, 5, and 7) in the left line are manipulated to evaluate the deflection Y while four graphs (2, 4, 6, and 8) in the right line are manipulated to evaluate the diameter D of the nozzle 18.

In the graphs of FIG. 30, it is understood that the graph (1) is correlative utmost and the graph (8) is correlative to the next.

When the graph (8) in FIG. 30 is rearranged according to equation (2):

$$Y=b(Dx-N) \tag{12}$$

where b is equivalent to ½ of a in equation (2).

In the general practical structure of the ink chamber 12, since values of K and N are similar, so that K≈N. Thus, when this condition is substituted into equation (2):

$$Y = aK(X-0.5) = aN\left(\frac{Dx}{2N}-0.5\right) = \frac{a(Dx-N)}{2} = b(Dx-N), \tag{13}$$

so that equation (13) becomes identical to equation (12).

Figure 31:
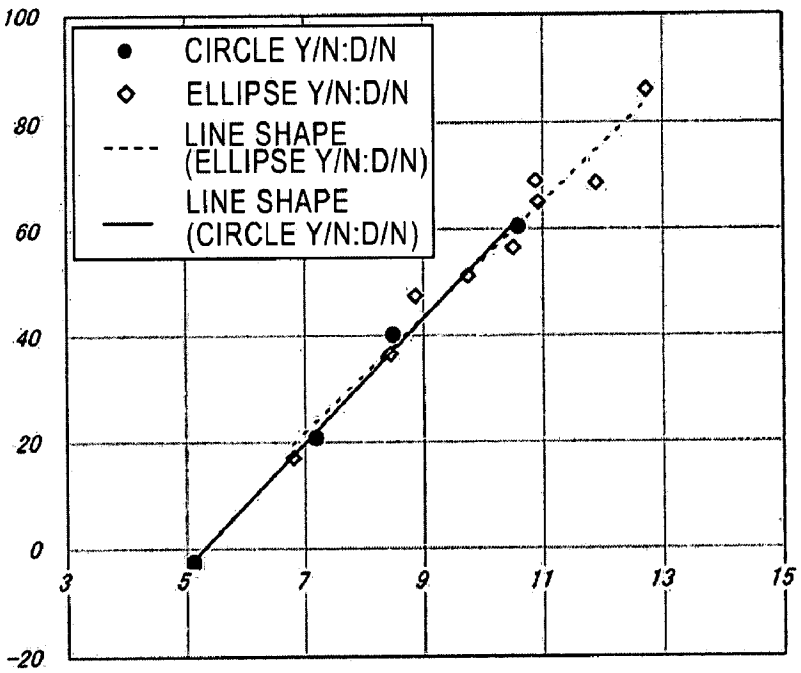
FIG. 31 includes graphs showing that correlation is not changed as long as within a specific range regarding the nozzle with opening shapes of a circle and an oblong.
Figure 31:
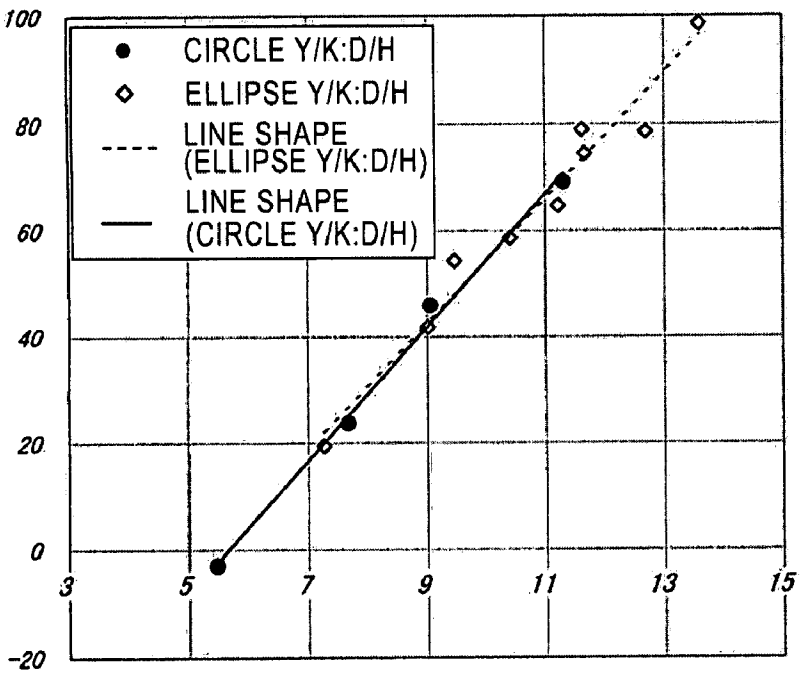

FIG. 31 includes graphs showing that correlation is not changed as long as within a specific range, even when the opening shape of the nozzle 18 is circular (Dx=Dy) or an oblong (Dx≠Dy). In FIG. 31, the combination of (1) and (8) in FIG. 30 is used.

From the results of FIG. 31, it is understood that even when the opening shape of the nozzle 18 is changed, the deflection Y is almost determined only by the value of Dx.

Next, changes in opening shape of the nozzle 18 and in dot diameter will be described.

Figure 33:
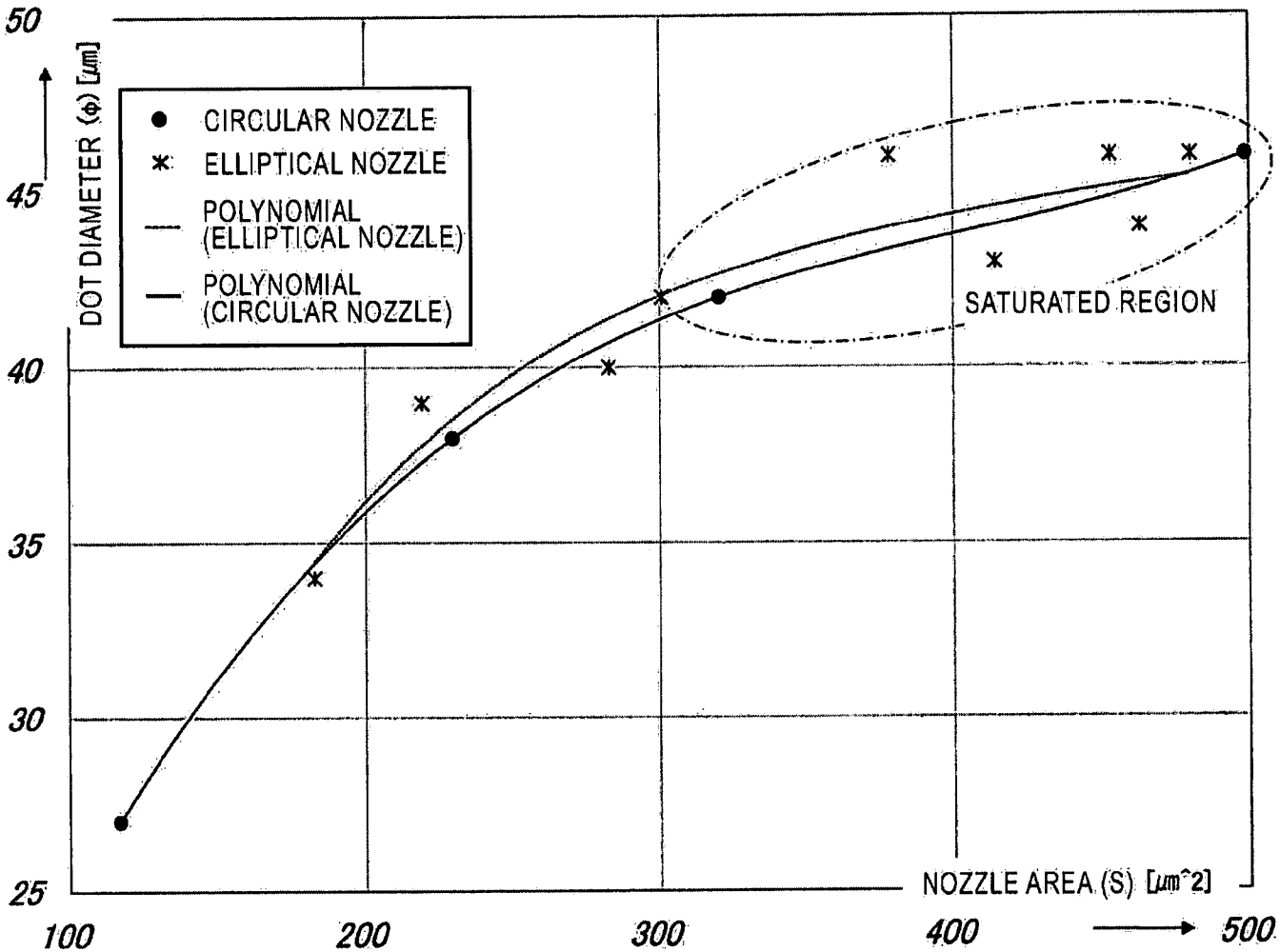
FIG. 33 is a graph showing the relationship between dot diameters and opening areas of the nozzle.
Figure 34:
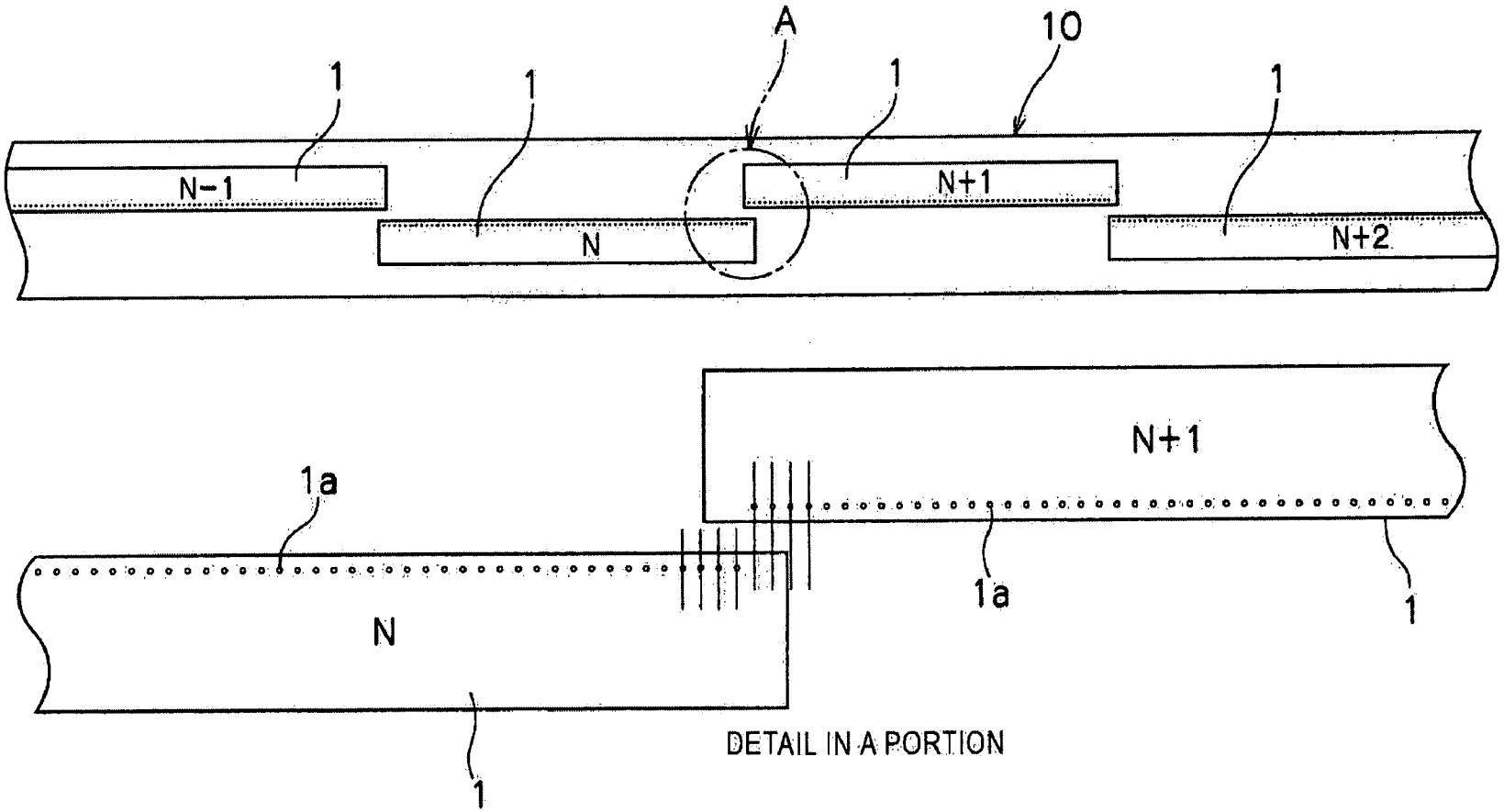
FIG. 34 is a plan view of a conventional line head.
Figure 35:
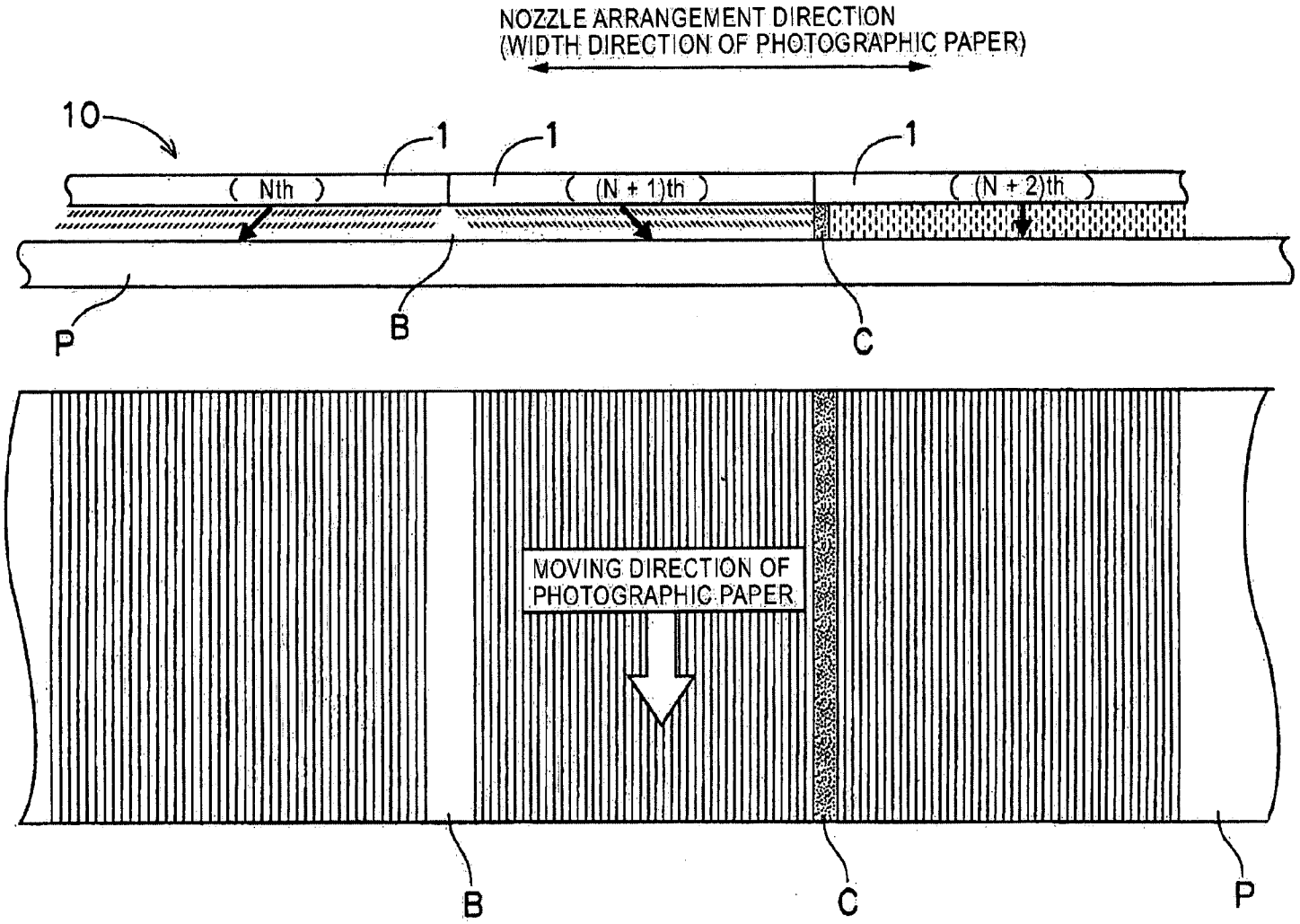
FIG. 35 includes a sectional view and a plan view showing image-printing state in the line head shown in FIG. 34.

FIG. 32 is a table showing a plurality of kinds of the opening diameters Dx and Dy of the nozzle 18 and opening areas S of the nozzle 18 versus dot diameters ϕ (printed on a recording medium) obtained from experimental results of Example 3. FIG. 33 is a graph showing the relationship between ϕ and S, assuming that the amount of ejected ink droplets corresponds to the dot diameter 100 one-to-one.

From FIG. 33, it is understood that the maximum deflection Y exhibits the proportionality true to the opening diameter Dx of the nozzle 18 in the arranging direction of the heating elements 13 considerably. On the other hand, the dot diameter, i.e. the amount of ejected ink droplets, is almost determined only by the opening area S.

The above-description means that when only the circular opening shape of the nozzle 18 is considered, if the maximum deflection Y is determined, the dot diameter is inevitably determined. Whereas, when an ellipse or an oblong (including equivalent ones) is selected only with the same opening diameter Dx, the above-description means that the dot diameter $\phi$ can be selected within some range by appropriately selecting the opening area S.

In a region of FIG. 33 designated as "saturated region", even when the opening area S is increased, the dot diameter $\phi$ does not change (not increase). The reason is that since the surface area of the heating element 13 and the volume of the ink chamber 12 determine the amount of ink droplets to be once ejected, when the volume of ink droplets to be ejected approaches this amount, the dot diameter $\phi$ also converges onto a predetermined value regardless of the opening area S.

To summarize Examples described above:

(1) The deflection Y is proportional to an opening diameter of the nozzle 18, and especially to the opening diameter Dx in the arranging direction of the heating elements 13.

(2) When the height H of the ink chamber (=K+N) is constant, the deflection Y is proportional to the thickness K of the barrier layer 16.

(3) The deflection Y is inversely proportional to the height H of the ink chamber.

(4) The deflection Y varies linearly according to changes in D/H using a point at D:H=1:2 as a starting point.

(5) Within variability range of the parameter in Example 2, if the height H of the ink chamber is constant, the thickness N of the nozzle sheet 17 scarcely affects deflection characteristics.

From these facts, the equation (2) described above is deduced.

What is claimed is:

1. A liquid-ejection apparatus comprising:

a liquid chamber for accommodating liquid to be ejected;

a heating element arranged within the liquid chamber; and a nozzle for ejecting liquid from the liquid chamber, wherein energy is applied to the heating element for heating it so as to apply an ejection force to the liquid in the liquid chamber so as to eject a liquid droplet from the nozzle, wherein the heating element is comprised of two juxtaposed bubble-generating regions with substantially the same surface-shape and substantially the same heating characteristics, and wherein the ejection direction of the liquid droplet is controlled by applying differing energy densities to the two respective bubble-generating regions so that the bubble-generating time for the two bubble-generating regions differ, and wherein a range of deflection from the perpendicular of an ink droplet of a nozzle includes a target landing position in an adjacent ink pixel normally deposited via an ink droplet ejected from an adjacent nozzle.

2. The apparatus according to claim 1, wherein when the liquid droplet is landed on an object arranged so as to oppose the ejection face of the nozzle, by changing an energy density difference applied to the two bubble-generating regions so as to change a component of the ejection force of the liquid droplet parallel to the ejection face of the nozzle, a landing position of the liquid droplet can be varied.

3. The apparatus according to claim 1, wherein in a range, with increasing difference between energy densities, the component of the ejection force of the liquid droplet parallel to an ejection face of the nozzle increases so as to have a peak value, then the component decreases using a point as an original point where energy density difference between the two heating elements is zero and the component of the ejection force of liquid droplet parallel to the ejection face of the nozzle is zero, the range comprises:

a first range in that with increasing difference between energy densities, the component of the ejection force of the liquid droplet parallel to the ejection face of the nozzle increases to the peak value around the original point;

a second range, which is adjacent to the first range, including a point where with decreasing energy density difference between the two bubble-generating regions, the component of the ejection force of the liquid droplet parallel to the ejection face of the nozzle becomes zero, and in the second range, the component of the ejection force of the liquid droplet parallel to the ejection face of the nozzle changes to the peak value; and a third range, which is adjacent to the first range, and is symmetrical with the second range about the point where the energy density difference between the two bubble-generating regions is zero so as to have the relationship obtained by inverting conditions of energy applied to the two bubble-generating regions in the second range, in the third range, with increasing energy density difference between the two bubble-generating regions, the component of the ejection force of the liquid droplet parallel to the ejection face of the nozzle changes after the peak value within a range including a point where the component of the ejection force of the liquid droplet parallel to the ejection face of the nozzle becomes zero, wherein in any one range of the first to third ranges, by changing the energy density difference applied to the two bubble-generating regions, the component of the ejection force of the liquid droplet parallel to the ejection face of the nozzle is controlled so as to change.

4. The apparatus according to claim 1, wherein in a range, with increasing difference between energy densities, the component of the ejection force of the liquid droplet parallel to the ejection face of the nozzle increases so as to have a peak value, then the component decreases using a point as an original point where energy density difference between the two heating elements is zero and the component of the ejection force of the liquid droplet parallel to the ejection face of the nozzle is zero, the range comprises:

a first range in that with increasing difference between energy densities, the component of the ejection force of the liquid droplet parallel to the ejection face of the nozzle increases to the peak value around the original point;

a second range, which is adjacent to the first range, including a point where with decreasing energy density difference between the two bubble-generating regions, the component of the ejection force of the liquid droplet parallel to the ejection face of the nozzle becomes zero, and in the second range, the component of the ejection force of the liquid droplet parallel to the ejection face of the nozzle changes to the peak value; and a third range, which is adjacent to the first range, being symmetrical with the second range about the point where the energy density difference between the two bubble-generating regions is zero so as to have the relationship obtained by inverting conditions of energy applied to the two bubble-generating regions in the second range, in the third range, with increasing energy density difference between the two bubble-generating regions, the component of the ejection force of the liquid droplet parallel to the ejection face of the nozzle changes after the peak value within a range including a point where the component of the ejection force of the liquid droplet parallel to the ejection face of the nozzle becomes zero, wherein in a plurality of ranges of the first to third ranges, by changing the energy density difference applied to the two bubble-generating regions, the component of the ejection force of the liquid droplet parallel to the ejection face of the nozzle is controlled so as to change.

5. The apparatus according to claim 1, wherein the two bubble-generating regions of the heating element arranged in the one liquid chamber are arranged symmetrically with respect to a plane normal to the ejection face of the nozzle, and the two regions pass through the axis of the nozzle, and wherein the liquid chamber and the nozzle are formed so as to have a symmetrical shape with respect to the plane.

6. The apparatus according to claim 1, wherein the relationship between a distance B between the centers of the two bubble-generating regions in the arranging direction of the two bubble-generating regions and an opening diameter Dx of the ejection face of the nozzle in the arranging direction of the two bubble-generating regions is:

$$Dx>B, \text{ and further}$$

wherein the relationship between a thickness N of the nozzle-forming member and the distance B between the centers is:

$$N<2\times B.$$

7. The apparatus according to claim 1, wherein the relationship between an opening diameter Dx of the ejection face of the nozzle in the arranging direction of the two bubble-generating regions and an opening diameter Dy of the ejection face of the nozzle in a direction perpendicular to the arranging direction of the two bubble-generating regions is:

$$Dx>Dy.$$

8. The apparatus according to claim 1, wherein a distance K between the surface of the heating element and the surface of the nozzle facing the heating element is expressed by the following equation:

$$0.75\times(\sqrt{2DxN}-N)\leqq K\leqq\sqrt{2DxN}-N,$$

where an opening diameter of the ejection face of the nozzle in the arranging direction of the two bubble-generating regions is Dx and a thickness of the nozzle-forming member is N.

9. The apparatus according to claim 1, wherein the relationship between an opening diameter Dx of the ejection face of the nozzle in the arranging direction of the two bubble-generating regions and an opening diameter Dx' of the surface of the nozzle facing the heating element in a direction perpendicular to the arranging direction of the two bubble-generating regions is:

$$Dx<Dx'.$$

10. The apparatus according to claim 1, wherein the internal wall of the nozzle is tapered so that the opening diameter of the nozzle increases toward the heating element from the ejection face of the nozzle.

11. The apparatus according to claim 1, wherein a plurality of the liquid chambers, of the heating elements, and of the nozzles are arranged in the arranging direction of the two bubble-generating regions of the heating element.

12. The apparatus according to claim 1, wherein a plurality of the liquid chambers with the same shape, a plurality of the heating elements with the same shape, and a plurality of the nozzles with the same shape are arranged in the arranging direction of the two bubble-generating regions of the heating element, and wherein one or more dummy nozzles are provided, that do not perform ejection, on either side of said plurality of nozzles.

13. The apparatus according to claim 1, wherein a plurality of the liquid chambers with the same shape, a plurality of the heating elements with the same shape, and a plurality of the nozzles with the same shape are arranged in the arranging direction of the two bubble-generating regions of the heating element, and wherein all of the plurality of nozzles are arranged linearly, and each liquid ejection face of the plurality of nozzles is arranged to be flush with each other.

14. A liquid-ejection apparatus comprising:

a liquid chamber for accommodating liquid to be ejected;

a heating element arranged within the liquid chamber; and a nozzle for ejecting liquid from the liquid chamber, wherein energy is applied to the heating element for heating it so as to apply an ejection force to the liquid in the liquid chamber so as to eject a liquid droplet from the nozzle, wherein the heating element is comprised of two juxtaposed bubble-generating regions with substantially the same surface-shape and substantially the same heating characteristics, and wherein the ejection direction of the liquid droplet is controlled by applying differing energy densities to the two respective bubble-generating regions, and wherein the relationship between a distance B between the centers of the two bubble-generating regions in the arranging direction of the two bubble-generating regions and an opening diameter Dx of the ejection face of the nozzle in the arranging direction of the two bubble-generating regions is:

$$Dx>B, \text{ and further}$$

wherein the relationship between a thickness N of the nozzle-forming member and the distance B between the centers is:

$$N<2\times B.$$

15. The liquid ejection apparatus according to claim 14, wherein the relationship between an opening diameter Dx of the ejection face of the nozzle in the arranging direction of the two bubble-generating regions and an opening diameter Dy of the ejection face of the nozzle in a direction perpendicular to the arranging direction of the two bubble-generating regions is:

$$Dx>Dy, \text{ and}$$

wherein a distance K between the surface of the heating element and the surface of the nozzle facing the heating element is expressed by the following equation:

$$0.75\times(\sqrt{2DxN}-N)\leqq K\geqq\sqrt{2DxN}-N,$$

where an opening diameter of the ejection face of the nozzle in the arranging direction of the two bubble-generating regions is Dx and a thickness of the nozzle-forming member is N.

* * * * *